US011065872B2

(12) United States Patent
Osaki et al.

(10) Patent No.: US 11,065,872 B2
(45) Date of Patent: Jul. 20, 2021

(54) LIQUID EJECTION HEAD

(71) Applicant: CANON KABUSHIKI KAISHA, Tokyo (JP)

(72) Inventors: Yasuhiko Osaki, Kamakura (JP); Shingo Okushima, Kawasaki (JP); Yoshiyuki Nakagawa, Kawasaki (JP); Kazuhiro Yamada, Yokohama (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/590,127

(22) Filed: Oct. 1, 2019

(65) Prior Publication Data

US 2020/0108605 A1 Apr. 9, 2020

(30) Foreign Application Priority Data

Oct. 5, 2018 (JP) ..... JP2018-190400

(51) Int. Cl.

| | |
|---|---|
| ***B41J 2/14*** | (2006.01) |
| ***B41J 2/045*** | (2006.01) |
| ***B41J 2/18*** | (2006.01) |
| *B41J 2/005* | (2006.01) |

(52) U.S. Cl.

CPC ..... *B41J 2/1404* (2013.01); *B41J 2/04563* (2013.01); *B41J 2/1433* (2013.01); *B41J 2/18* (2013.01); *B41J 2002/0055* (2013.01); *B41J 2202/12* (2013.01)

(58) Field of Classification Search

CPC .... B41J 2/04563; B41J 2/1433; B41J 2/1404; B41J 2202/12; B41J 2002/0055; B41J 2/18

See application file for complete search history.

(56) References Cited

U.S. PATENT DOCUMENTS 9,981,464 B2 * 5/2018 Karita ..... B41J 2/155

FOREIGN PATENT DOCUMENTS

JP 2008-526553 A 7/2008

* cited by examiner

*Primary Examiner* — Geoffrey S Mruk

(74) *Attorney, Agent, or Firm* — Canon U.S.A., Inc. IP Division

(57) ABSTRACT

A liquid ejection head includes a nozzle including an ejection port for ejecting a liquid for performing recording on a recording medium, and a pressure chamber in which an energy generating element that generates energy used for ejecting the liquid from the ejection port is disposed; and a heating unit that heats the liquid. In the liquid ejection head, the liquid in the pressure chamber is circulated to and from the outside of the pressure chamber, and an average number of preliminary ejections per nozzle during an operation period in which the recording is performed is equal to or greater than 0 and equal to or less than 20.

18 Claims, 28 Drawing Sheets

LIQUID EJECTION HEAD

BACKGROUND

Field of the Disclosure

The present disclosure generally relates to a liquid ejection head and a liquid ejection apparatus, including a recording element which ejects a liquid such as ink, for the purpose of recording an image.

Description of the Related Art

A liquid ejection head that applies a voltage pulse to an element generating energy for ejecting a liquid according to recording data, and ejects a liquid such as ink by utilizing the generated energy is widely useful because the liquid ejection head can output an image with high definition and high speed.

In particular, a liquid ejection apparatus including a page-wide type liquid ejection head including a plurality of recording element substrates disposed corresponding to the width of recording paper has been rapidly spread in recent years because higher speed output is possible. Japanese Patent Application Laid-Open No. 2008-526553 discloses a page-wide type liquid ejection head. In a known configuration, the liquid ejection head is provided with a heating unit such as a heater in order to adjust the head temperature to a predetermined temperature during a printing operation (hereinafter, temperature adjustment).

SUMMARY

The disclosure provides a liquid ejection head including a nozzle including an ejection port for ejecting a liquid, and a pressure chamber in which an energy generating element that generates energy used for ejecting the liquid from the ejection port is disposed; and a heating unit that heats the liquid, in which during an operation period in which a recording on a recording medium is performed, the liquid in the pressure chamber is circulated to and from an outside of the pressure chamber, and an average number of preliminary ejections per nozzle of all the nozzles during the operation period is equal to or greater than 0 and equal to or less than 20.

Further features of the present disclosure will become apparent from the following description of exemplary embodiments with reference to the attached drawings.

DESCRIPTION OF THE EMBODIMENTS

Figure 1:
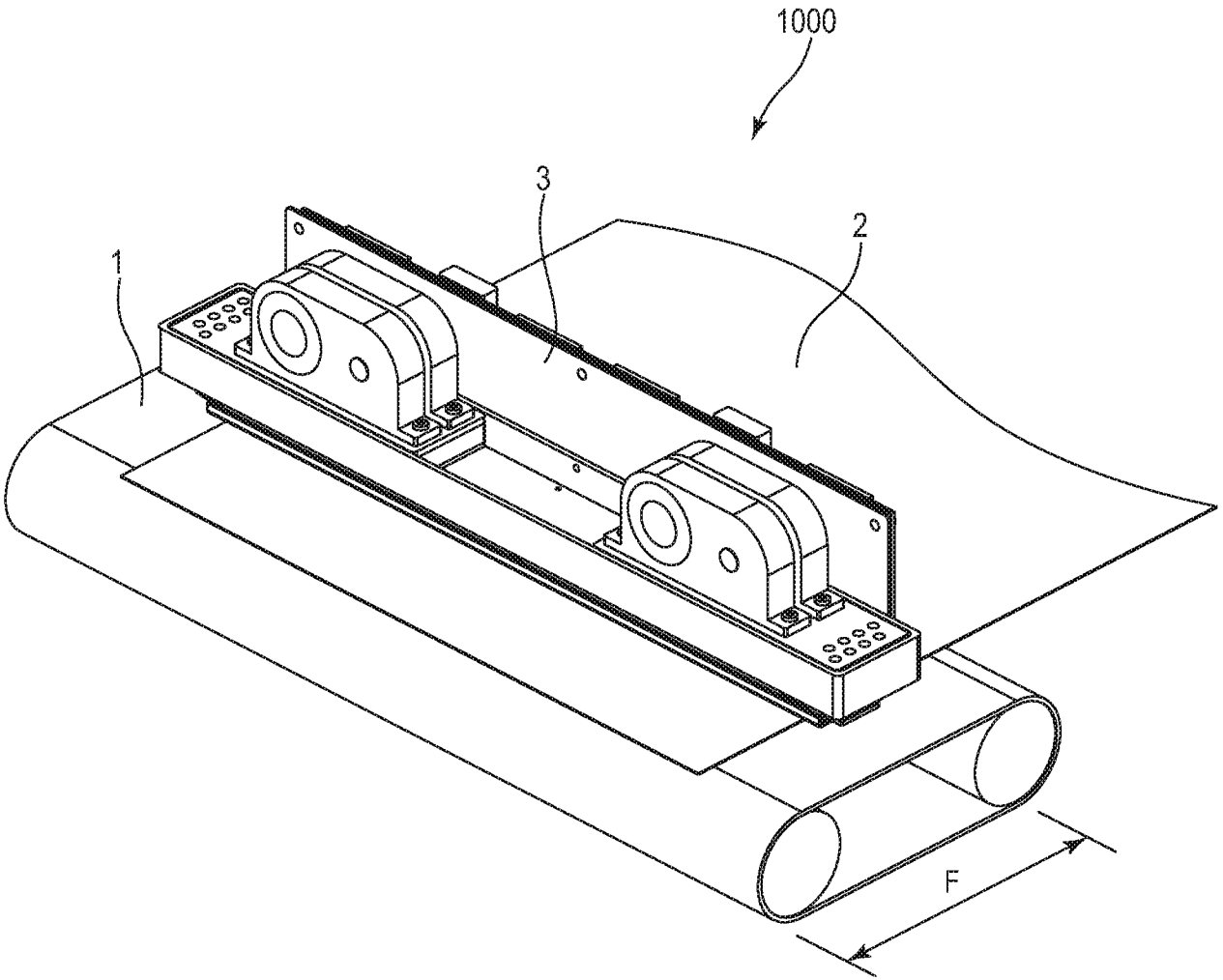
FIG. 1 is a perspective view illustrating a schematic configuration of a liquid ejection apparatus of a first embodiment.

A liquid ejection head such as an ink jet head may perform an operation called a preliminary ejection that ejects a liquid to a capping member installed in a printer body toward a recording medium during a recording operation separately from original ejection of a liquid for image formation. The preliminary ejection is performed for the purpose of preventing printing failure and deterioration of image quality due to an increase in viscosity of the liquid in the ejection port caused by drying, or the like. However, when a preliminary ejection is performed during the above-described temperature adjusting operation of the liquid ejection head, ink kept at a constant temperature is ejected and the cooled ink flows in, and thus the head temperature temporarily decreases even if the temperature adjusting operation is performed. Further, additional power consumption for raising the temperature again becomes necessary. In particular, in a page-wide type liquid ejection head having a large number of ejection ports, since the amount of ink required for a preliminary ejection is also increased, the influence of these is increased.

The present disclosure has been made to solve the above problems. That is, one aspect of the disclosure is to provide a liquid ejection head and a liquid ejection apparatus, capable of suppressing a temporary temperature change and an increase in power consumption due to preliminary ejections in a liquid ejection head performing a temperature adjusting operation.

Embodiments of the present disclosure will be described below by using the drawings. However, the following description does not limit the scope of the disclosure. For example, although a thermal system for generating air bubbles in the liquid by a heat generating element and ejecting liquid from an ejection port is adopted in the present embodiment, the present disclosure can be applied to a liquid ejection head adopting a piezo system and various other liquid ejection systems.

In the present embodiment, an ink jet liquid ejection apparatus that circulates ink between the buffer tank (liquid container) and the ink jet recording head (liquid ejection head) has been described, but other forms may be used. For example, a form may be used in which tanks are respectively provided on the upstream side and the downstream side of the liquid ejection head, and the ink is made to flow from one tank to the other tank to flow the ink in the pressure chamber.

The so-called page-wide type liquid ejection head having a length corresponding to the width of the recording medium is used in the present embodiment, but the present disclosure can also be applied to a so-called serial liquid ejection head which performs recording while scanning the recording medium. The serial liquid ejection head includes, for example, a configuration in which one recording element substrate for black ink and one recording element substrate for color ink are mounted. However, the serial liquid ejection head is not limited thereto, and there may be adopted a form in which a short line head shorter than the width of the recording medium and having several recording element substrates disposed such that ejection ports overlap each other in an ejection port line direction may be formed to scan the recording medium.

First Embodiment

Description of a Liquid Ejection Apparatus

The schematic configuration of a liquid ejection apparatus of the present disclosure, especially an ink jet recording apparatus 1000 (hereinafter also referred to as a liquid ejection apparatus) that performs recording by discharging ink is illustrated in FIG. 1. The liquid ejection apparatus 1000 includes a conveying unit 1 that conveys a recording medium 2 and a page-wide type liquid ejection head 3 disposed approximately orthogonally to the conveying direction of the recording medium. The liquid ejection apparatus is a page-wide type liquid ejection apparatus which performs continuous recording by one pass while continuously or intermittently conveying a plurality of recording media 2. The recording medium 2 may be not only cut paper but also continuous roll paper. The liquid ejection head 3 can perform full color printing by cyan, magenta, yellow, and black (CMYK) inks. A liquid supply unit which is a supply path for supplying a liquid to a liquid ejection head as described later, a main tank, and a buffer tank (refer to FIG. 2) are fluidly connected to the liquid ejection head. An electric control unit that transmits electrical power and an ejection control signal to the liquid ejection head 3 is electrically connected to the liquid ejection head 3. The liquid path and the electric signal path in the ejection head 3 will be described later.

Description of First Circulation Path

Figure 2:
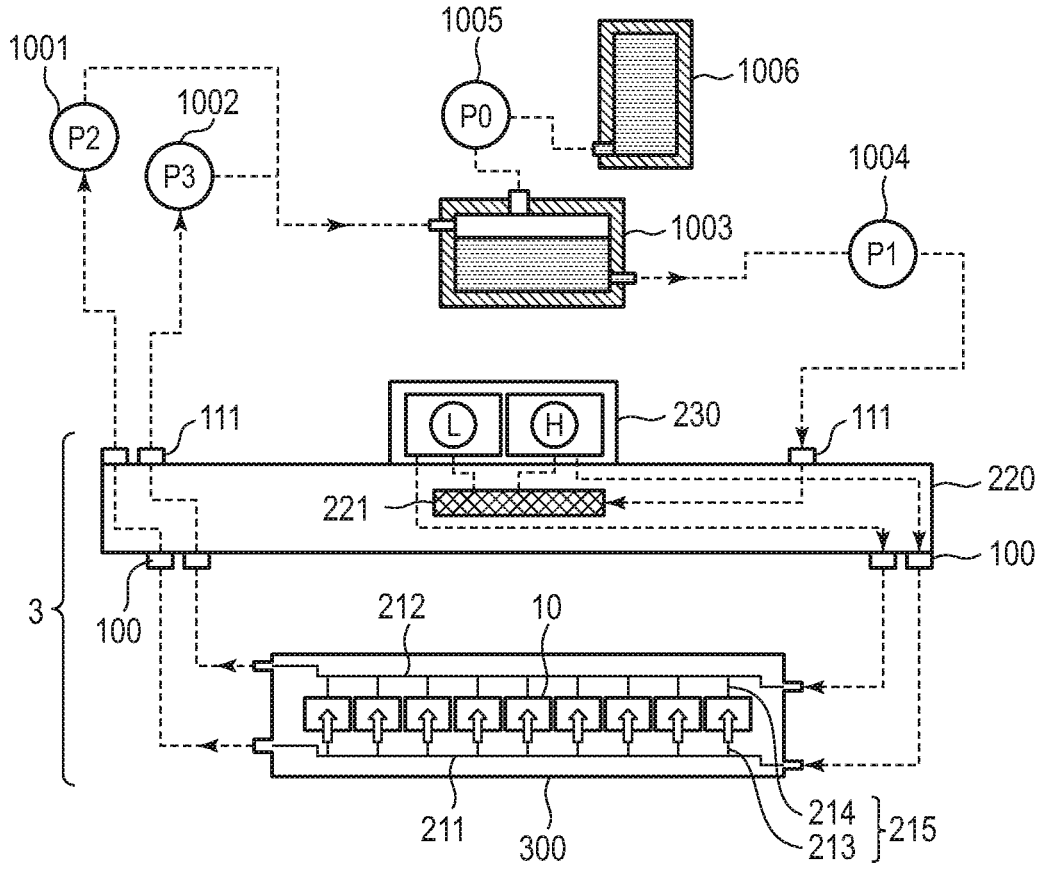
FIG. 2 is a diagram illustrating a circulation flow passage of the liquid ejection apparatus illustrated in FIG. 1.

FIG. 2 is a schematic diagram illustrating a first circulation path which is one form of a circulation path applied to a liquid ejection apparatus, and the liquid ejection head 3 is fluidly connected to a first circulation pump (high pressure side) 1001, a first circulation pump (low pressure side) 1002, a buffer tank 1003, and the like. Although FIG. 2 shows only a path through which one color ink of the CMYK inks flows to simplify the description, circulation paths for four colors are actually provided in the liquid ejection head 3 and the liquid ejection apparatus body. The buffer tank 1003 as a sub-tank connected to a main tank 1006 has an ambient air communication port (not illustrated) for communicating the inside of the tank with the outside, and can discharge air bubbles in ink to the outside. The buffer tank 1003 is also connected to a replenishing pump 1005. When the liquid is consumed by the liquid ejection head 3 by ejecting the ink from the ejection port of the liquid ejection head, such as recording or suction recovery by ejecting the ink, the replenishing pump 1005 transfers ink of the consumed amount from the main tank 1006 to the buffer tank 1003.

Two first circulation pumps 1001, 1002 as power sources for circulation have the role of flowing the liquid to the buffer tank 1003 through a liquid connecting part 111 of the liquid ejection head 3. A positive-displacement pump having a quantitative liquid delivery capability can be preferably used as the first circulation pump. Specifically, a tube pump, a gear pump, a diaphragm pump, and a syringe pump can be used, and for example, a general constant flow rate valve or relief valve may be provided at the pump outlet to secure a constant flow rate. When the liquid ejection head 3 is driven, a fixed amount of ink flows in a common supply flow passage 211 and a common recovery flow passage 212 by a first circulation pump (high pressure side) 1001 and a first circulation pump (low pressure side) 1002. The flow rate is preferably set to be equal to or more than a flow rate such that a temperature difference between respective recording element substrates 10 within the liquid ejection head 3 does not influence recording image quality. However, when an excessively large flow rate is set, the negative pressure difference in each recording element substrate 10 is significantly increased due to the effect of pressure loss of a flow passage in the liquid ejection unit 300, resulting in uneven density of the image. Therefore, the flow rate is preferably set while considering the temperature difference and the negative pressure difference between the respective recording element substrates 10.

A negative-pressure control unit 230 is provided in the path between the second circulation pump 1004 and the liquid ejection unit 300. The negative-pressure control unit 230 has a function of maintaining pressure on the downstream side (that is, on the liquid ejection unit 300 side) of the negative-pressure control unit 230 at a preset constant pressure even in a case where the flow rate of the circulation system fluctuates due to the difference in the duty of recording. Any mechanism may be used as two pressure adjusting mechanisms constituting the negative-pressure control unit 230, as long as the pressure downstream of the negative-pressure control unit 230 can be controlled with a fluctuation within a fixed range or less with a desired set pressure as a center. As an example, a mechanism similar to a so-called "pressure reducing regulator" can be adopted. In a case where the pressure reducing regulator is used, the upstream side of the negative-pressure control unit 230 is preferably pressurized via a liquid supply unit 220 by the second circulation pump 1004 as illustrated in FIG. 2. By doing so, the influence of the water head pressure of the buffer tank 1003 on the liquid ejection head 3 can be suppressed, and thus the degree of freedom of the layout of the buffer tank 1003 in the liquid ejection apparatus 1000 can be widened. The second circulation pump 1004 may have a head pressure equal to or higher than a fixed pressure within a range of an ink circulation flow rate used when the liquid ejection head 3 is driven, and a turbo pump, a positive-displacement pump, or the like can be used. Specifically, a diaphragm pump can be applied. Instead of the second circulation pump 1004, for example, a head tank disposed with a fixed head difference with respect to the negative-pressure control unit 230 can also be applied.

As illustrated in FIG. 2, the negative-pressure control unit 230 includes the two pressure adjusting mechanisms that are respectively set to have mutually different control pressures. A higher-pressure setting side (denoted by H in FIG. 2) and a lower-pressure side (denoted by L in FIG. 2) of the two negative-pressure adjusting mechanisms are respectively connected to the common supply flow passage 211 and the common recovery flow passage 212 within the liquid ejection unit 300 via the inside of the liquid supply unit 220. The liquid ejection unit 300 is provided with the common supply flow passage 211, the common recovery flow passage 212, and an individual supply flow passage 213*a* and an individual recovery flow passage 214*b* communicating with each recording element substrate. Since the individual supply flow passage 213 communicates with the common supply flow passage 211 and the common recovery flow passage 212, a flow (arrow in FIG. 2) in which a part of the liquid flows from the common supply flow passage 211 through the internal flow passage of the recording element substrate 10 to the common recovery flow passage 212 is generated. This is because, since the pressure adjusting mechanism H is connected to the common supply flow passage 211 and the pressure adjusting mechanism L is connected to the common recovery flow passage 212, differential pressure is generated between the two common flow passages.

Thus, in the liquid ejection unit 300, while the liquid is made to flow so as to pass through the common supply flow passage 211 and the common recovery flow passage 212, a flow such that a part of the liquid passes through each recording element substrate 10 is generated. By such a configuration, ink flow can be generated even at an ejection port and a pressure chamber where no recording is performed when recording is performed by the liquid ejection head 3, so the increase in viscosity of ink in the part can be suppressed. The viscosity-increased ink or foreign matter in the ink can be ejected to the common recovery flow passage 212. By circulating inside and outside the pressure chamber in this way, the preliminary ejection from the liquid ejection head and the recovery operation of the liquid ejection head can be suppressed, and thus high-quality recording can be performed at high speed. As will be described later in detail, the number of preliminary ejections can be suppressed or eliminated by circulation inside and outside the pressure chamber, a temperature change at the time of temperature adjustment of the liquid ejection head can be suppressed.

Description of Configuration of Liquid Ejection Head

Figure 3A:
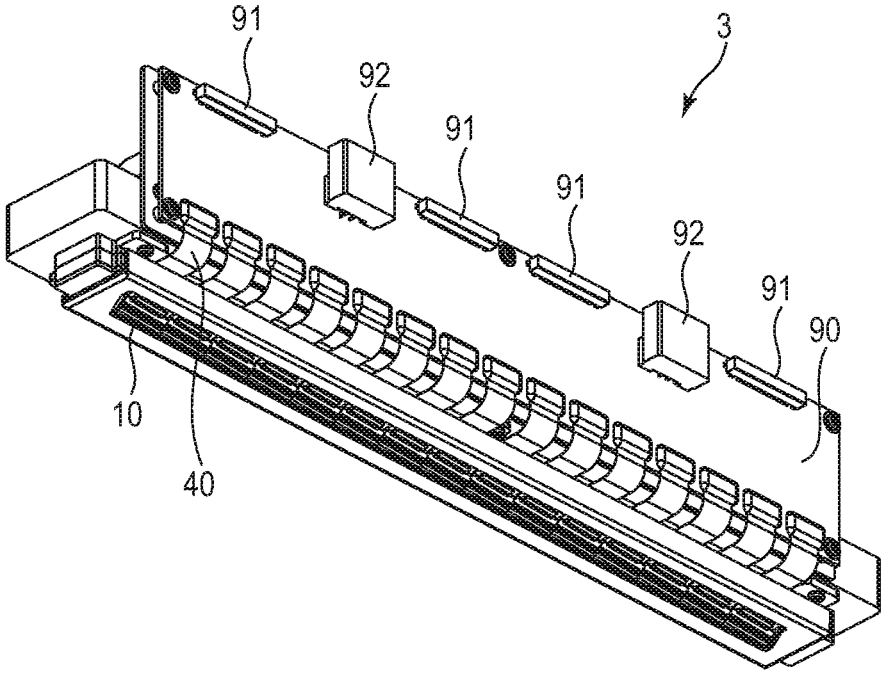
FIGS. 3A and 3B are perspective views illustrating a liquid ejection head of the first embodiment of the present disclosure.
Figure 3B:
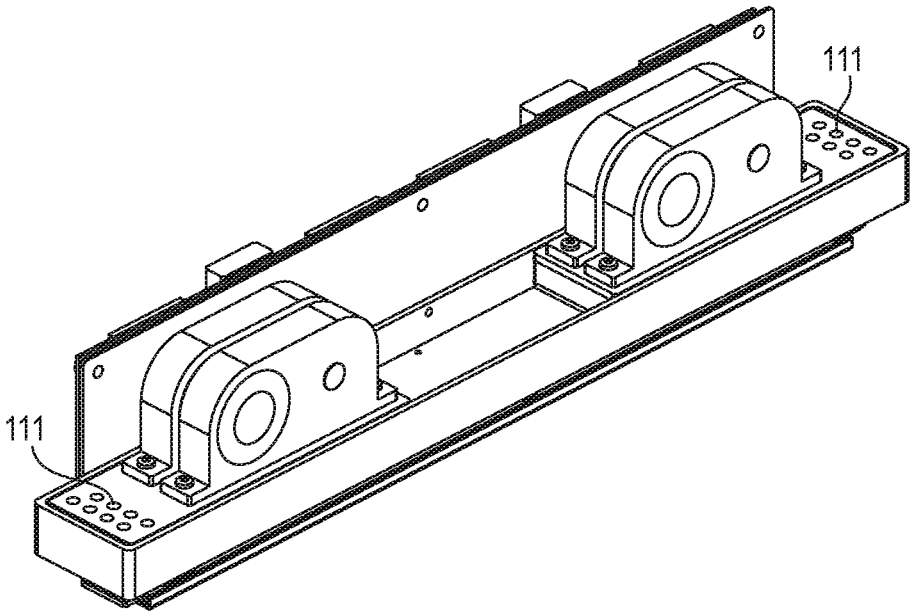

The configuration of the liquid ejection head 3 according to the first embodiment will be described. FIGS. 3A and 3B are perspective views of the liquid ejection head 3 according to the present embodiment. The liquid ejection head 3 is a page-wide type liquid ejection head in which 15 recording element substrates 10 each capable of discharging four-color inks of C/M/Y/K are linearly arranged (inline arrangement). The present disclosure is not limited to this aspect, and is also applicable to the liquid ejection head 3 in which a plurality of recording element substrates 10 are arranged in staggered manner. As illustrated in FIG. 3A, the liquid ejection head 3 includes signal input terminals 91 and electrical power supply terminals 92 which are electrically connected to the recording element substrates 10 via a flexible wiring substrate 40 and an electrical wiring substrate 90. The signal input terminals 91 and the electrical power supply terminals 92 are electrically connected to the control unit of the body of the liquid ejection apparatus 1000, and supply an ejection drive signal and electric power required for discharge to the recording element substrate 10, respectively. By collecting the wirings by the electric circuits in the electrical wiring substrate 90, the number of signal output terminals 91 and electrical power supply terminals 92 can be reduced as compared with the number of recording element substrates 10. Thus, the number of electric connection parts required to be removed when the liquid ejection head 3 is assembled to the liquid ejection apparatus 1000 or when the liquid ejection head is replaced can be reduced. As illustrated in FIG. 3B, the liquid connecting parts 111 provided at both ends of the liquid ejection head 3 are connected to a liquid supply system of the liquid ejection apparatus 1000. Thus, the inks of four colors (CMYK) are supplied from the supply system of the liquid ejection apparatus 1000 to the liquid ejection head 3, and the ink passing through the liquid ejection head 3 is recovered to the supply system of the liquid ejection apparatus 1000. Thus, the ink of each color can be circulated through the path of the liquid ejection apparatus 1000 and the path of the liquid ejection head 3. More specifically, ink is circulated through a pressure chamber 23 (FIGS. 9A to 9C) of the liquid ejection head 3.

Figure 4:
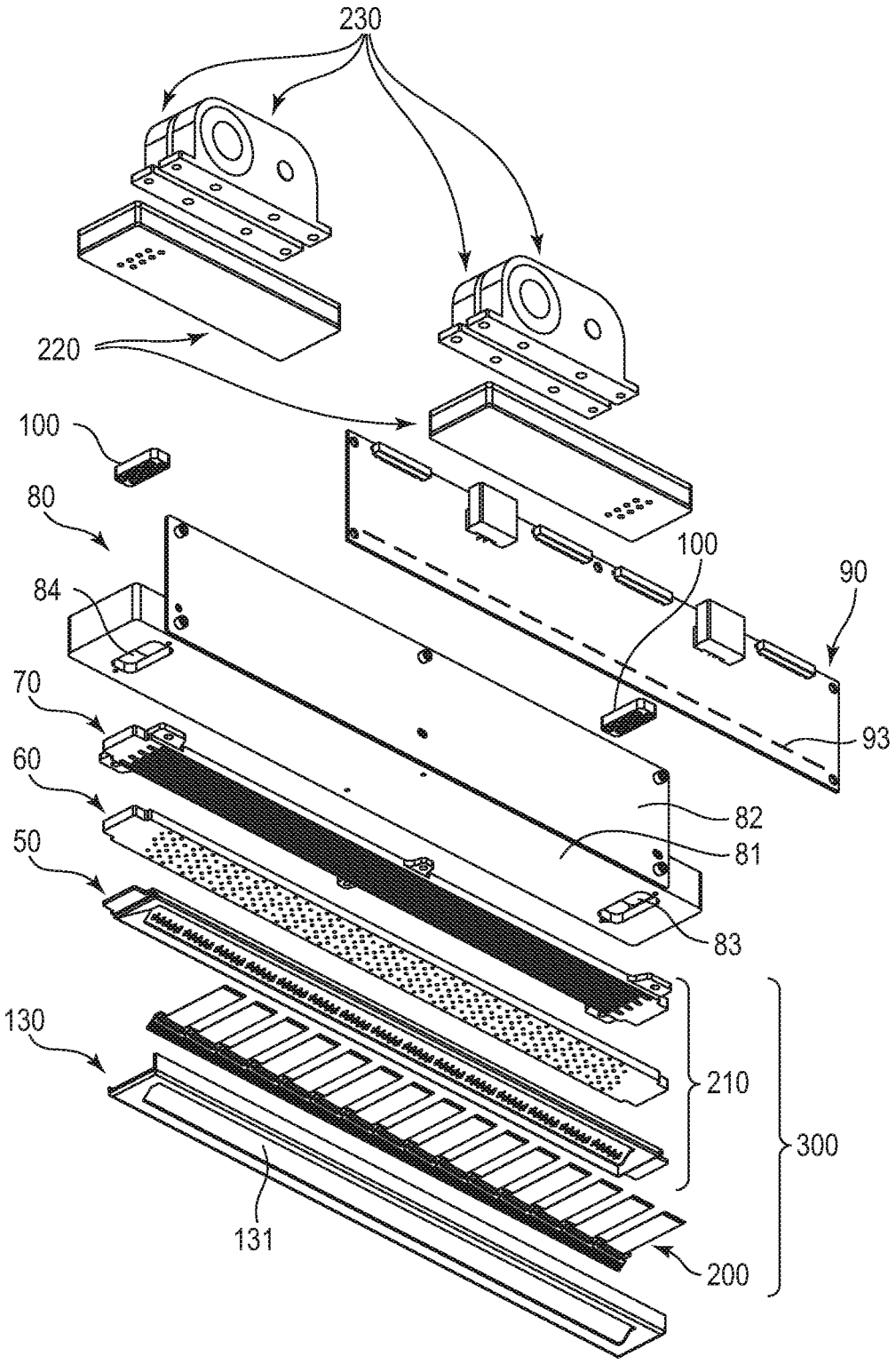
FIG. 4 is an exploded perspective view of the liquid ejection head illustrated in FIGS. 3A and 3B.

An exploded perspective view of each component or unit constituting the liquid ejection head 3 is illustrated in FIG. 4. The liquid ejection unit 300, the liquid supply unit 220, and the electrical wiring substrate 90 are attached to a housing 80. The liquid supply unit 220 is provided with the liquid connecting part 111 (FIG. 2), and a filter 221 (FIG. 2) of each color communicating with each opening of the liquid connecting part 111 is provided inside the liquid supply unit 220 to remove foreign matter in the supplied ink. The two liquid supply units 220 are respectively provided with filters 221 of two colors. The liquid passing through the filter 221 is supplied to the negative-pressure control unit 230 disposed on the supply unit 220 corresponding to each color. The negative-pressure control unit 230 is a unit including a pressure adjusting valve of each color, and largely attenuates a pressure loss change in the supply system of the liquid ejection apparatus 1000 (the supply system on the upstream side of the liquid ejection head 3) caused by the fluctuation of the flow rate of the liquid by the valve or the spring member provided inside. Thus, the negative pressure change on the downstream side (the liquid ejection unit 300 side) of the pressure control unit is suppressed within a certain fixed range, and the negative pressure can be stabilized. As illustrated in FIG. 2, two pressure adjusting valves of each color are incorporated in the negative-pressure control unit 230 of each color, and set to different control pressures. The high pressure side communicates with the common supply flow passage 211 in the liquid ejection unit 300 and the low pressure side communicates with the common recovery flow passage 212 through the liquid supply unit 220.

The housing 80 includes a liquid ejection unit support part 81 and an electrical wiring substrate support part 82, supports the liquid ejection unit 300 and the electrical wiring substrate 90, and secures the rigidity of the liquid ejection head 3. The electrical wiring substrate support part 82 supports the electrical wiring substrate 90, and is fixed to the liquid ejection unit support part 81 by screwing. The liquid ejection unit support part 81 corrects warpage and deformation of the liquid ejection unit 300 to secure relative position accuracy of the plurality of recording element substrates 10, and thereby suppressing stripes and unevenness in the recorded matter. Therefore, the liquid ejection unit support part 81 preferably has sufficient rigidity, and a metallic material such as SUS and aluminum or ceramic such as alumina is suitably used as a material. The liquid ejection unit support part 81 is provided with openings 83 and 84 into which the joint rubber 100 is inserted. The liquid supplied from the liquid supply unit 220 is guided to a third flow passage member 70 constituting the liquid ejection unit 300 through the joint rubber.

The liquid ejection unit 300 includes a plurality of ejection modules 200 and a flow passage member 210, and a cover member 130 is attached to the surface of the liquid ejection unit 300 on the recording medium side. As illustrated in FIG. 4, the cover member 130 is a member having a frame-like surface provided with a long opening 131, and the recording element substrate 10 and a sealing member 110 (FIGS. 8A and 8B) included in the ejection module 200 are exposed from the opening 131. A frame part around the opening 131 has a function as an abutting surface of a cap member capping the liquid ejection head 3 in the standby state of recording. Therefore, it is preferred that an adhesive, a sealing material, a filler material, or the like is applied along the periphery of the opening 131 to fill irregularities or gaps on an ejection port surface of the liquid ejection unit 300 so that a closed space is formed at the time of the capping.

Next, the configuration of the flow passage member 210 included in the liquid ejection unit 300 will be described. As illustrated in FIG. 4, the flow passage member 210 is formed by laminating a first flow passage member 50, a second flow passage member 60, and a third flow passage member 70, and distributes the liquid supplied from the liquid supply unit 220 to each ejection module 200. The flow passage member returns the liquid recirculated from the ejection module 200 to the liquid supply unit 220. The flow passage member 210 is fixed to the liquid ejection unit support part 81 by screwing, and thereby, the warpage or deformation of the flow passage member 210 is suppressed.

Figure 5A:
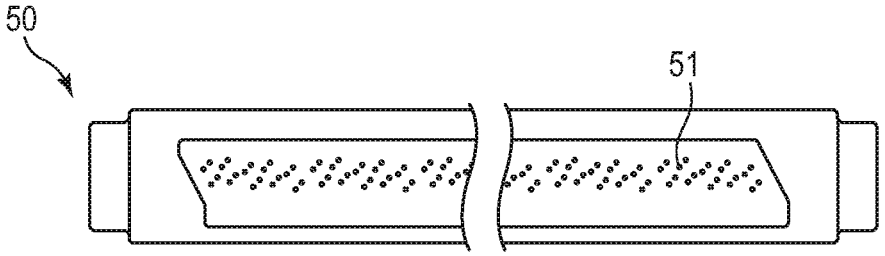
FIGS. 5A, 5B, 5C, 5D, 5E and 5F are plan views and bottom views of each flow passage member of the liquid ejection head illustrated in FIGS. 3A and 3B.
Figure 5B:
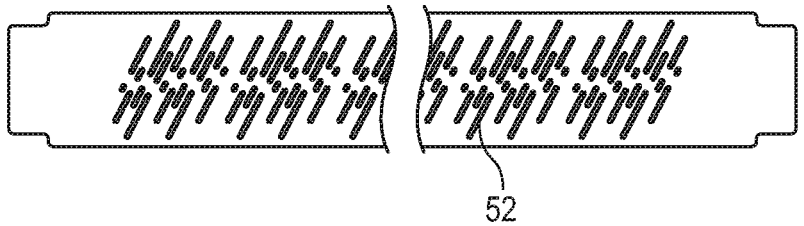
Figure 5C:
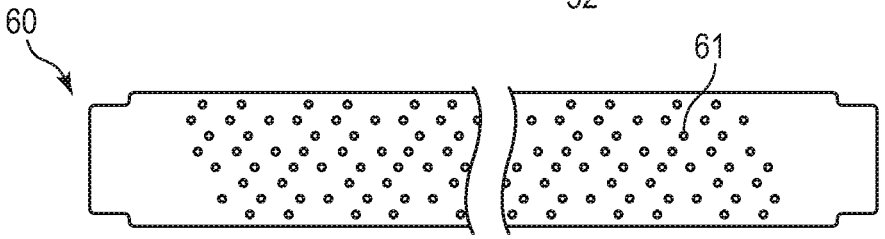
Figure 5D:
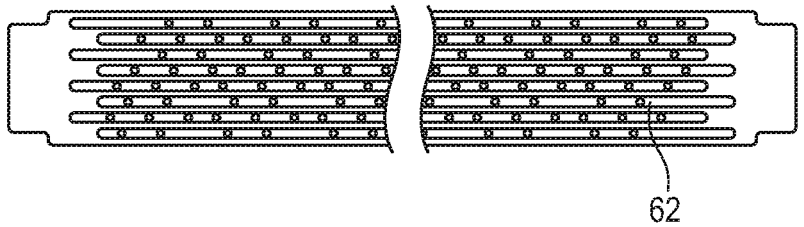
Figure 5E:
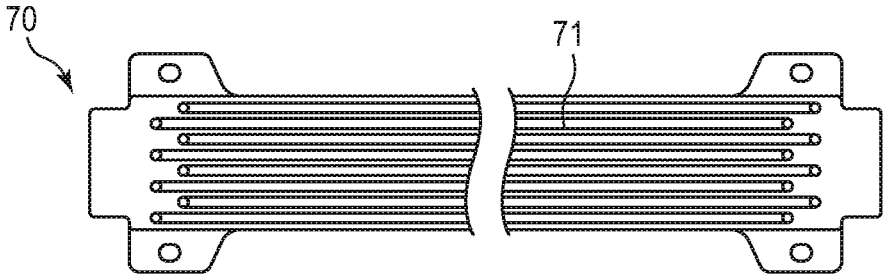
Figure 5F:
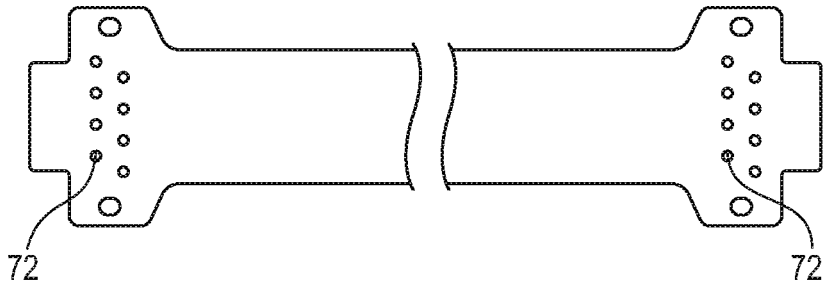
Figure 6:
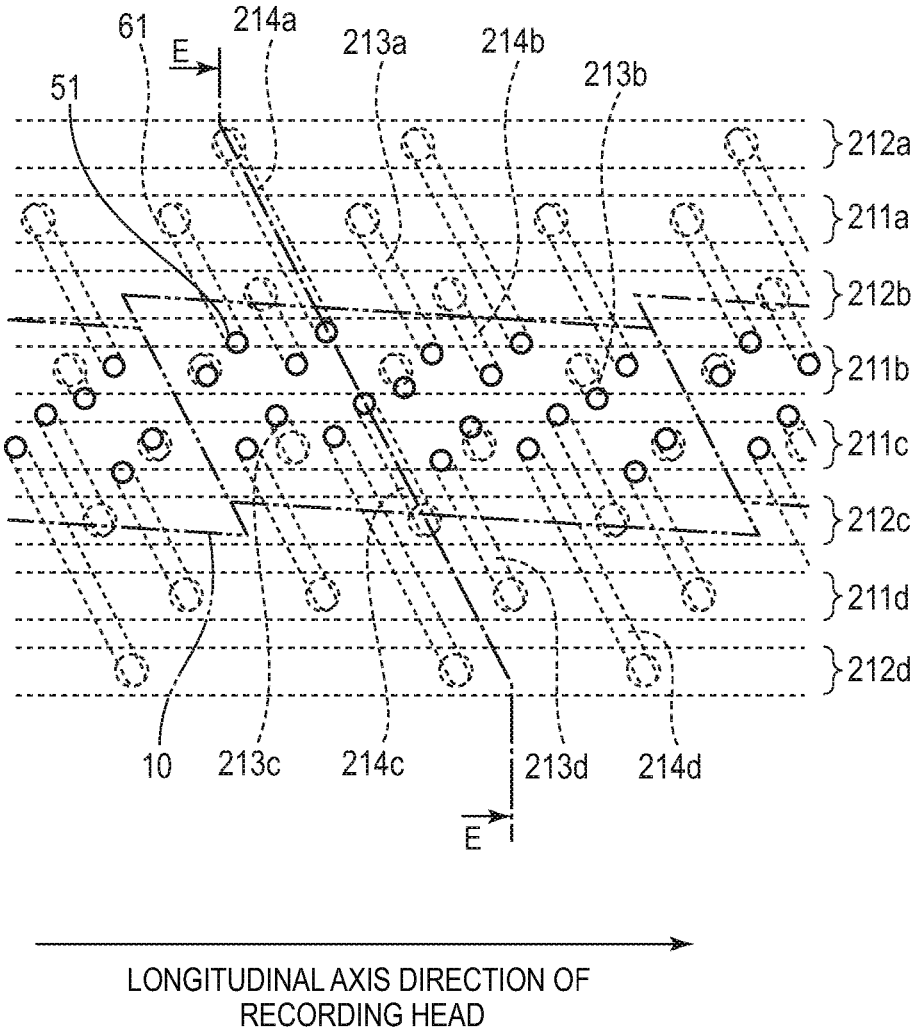
FIG. 6 is a perspective view of partial enlargement of the flow passage member illustrated in FIGS. 5A to 5F.

FIGS. 5A to 5F are diagrams illustrating the front and back surfaces of the respective flow passage members of the first to third flow passage members. FIG. 5A shows the surface of the first flow passage member 50 on the side where the ejection module 200 is mounted, and FIG. 5F shows the surface of the third flow passage member 70 on the side where it abuts on the liquid ejection unit support part 81. The first flow passage member 50 and the second flow passage member 60 are joined to each other such that abutting surfaces of respective flow passage members which are FIG. 5B and FIG. 5C are opposed to each other, and the second flow passage member and the third flow passage member are joined to each other such that abutting surfaces of respective flow passage members which are FIG. 5D and FIG. 5E are opposed to each other. By joining the second flow passage member 60 and the third flow passage member 70 to each other, eight common flow passages extending in the longitudinal direction of the flow passage member are formed by common flow passage grooves 62, 71 formed in respective flow passage members. Thus, a set of the common supply flow passage 211 and the common recovery flow passage 212 is formed in the flow passage member 210 for each color (FIG. 6). Communication ports 72 of the third flow passage member 70 communicate with respective holes of the joint rubber 100, and fluidly communicate with the liquid supply unit 220. A plurality of communication ports 61 is formed on the bottom surfaces of the common flow passage grooves 62 of the second flow passage member 60, and communicates with one ends of individual flow passage grooves 52 of the first flow passage member 50. Communication ports 51 are formed at the other ends of the individual flow passage grooves 52 of the first flow passage member 50, and the other ends fluidly communicate with the plurality of ejection modules 200 through the communication ports 51. The individual flow passage grooves 52 enable the flow passages to be collected on the center side of the flow passage member.

It is preferable that the first to third flow passage members have corrosion resistance to the liquid and are made of a material having a low coefficient of linear expansion. As a material, for example, a composite material (resin material) to which an inorganic filler such as silica fine particles and fibers is added using alumina, liquid crystal polymer (LCP), polyphenyl sulfide (PPS), and polysulfone (PSF) as a base material can be suitably used. As the forming method of the flow passage member 210, three flow passage members may be laminated and bonded to each other, or in a case where a composite resin material is selected as a material, a bonding method by welding may be used.

Then, the connection relationship of flow passages in the flow passage member 210 will be described by using FIG. 6. FIG. 6 shows a perspective view in which a part of a flow passage in the flow passage member 210 formed by joining first to third flow passage members is enlarged from a surface side of the first flow passage member 50 on which the ejection module 200 is mounted. The flow passage member 210 is provided with common supply flow passages 211 (211*a*, 211*b*, 211*c*, 211*d*) and common recovery flow passages 212 (212*a*, 212*b*, 212*c*, 212*d*) extending in the longitudinal direction of the liquid ejection head 3, for respective colors. A plurality of individual supply flow passages (213*a*, 213*b*, 213*c*, 213*d*) formed by the individual flow passage grooves 52 is connected to the common supply flow passages 211 of respective colors through the communication ports 61. A plurality of individual recovery flow passages (214*a*, 214*b*, 214*c*, 214*d*) formed by the individual flow passage grooves 52 is connected to the common recovery flow passages 212 of respective colors through the communication ports 61. By such a flow passage configuration, ink can be collected on the recording element substrate 10 positioned at the center of the flow passage member from each common supply flow passage 211 through the individual supply flow passage 213. Additionally, ink can be recovered from the recording element substrate 10 to each common recovery flow passage 212 through the individual recovery flow passage 214.

Figure 7:
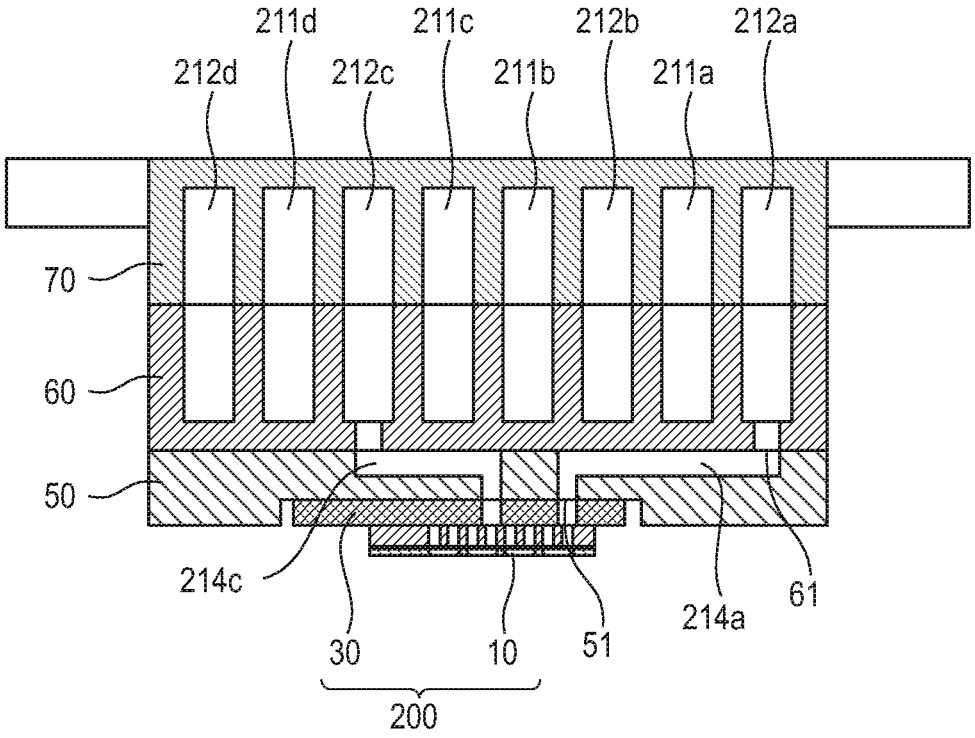
FIG. 7 is a sectional view of the liquid ejection head illustrated in FIGS. 3A and 3B.

FIG. 7 is a diagram illustrating a cross section taken along line E-E of FIG. 6. As illustrated in FIG. 7, the individual recovery flow passages (214*a*, 214*c*) communicate with the ejection module 200 through the communication ports 51. Only the individual recovery flow passages (214*a*, 214*c*) are illustrated in FIG. 7, but in another cross section, the individual supply flow passage 213 communicates with the ejection module 200 as illustrated in FIG. 6. A flow passage for supplying ink from the first flow passage member 50 to a recording element 15 (FIGS. 9A to 9C) provided on the recording element substrate 10 is formed on a supporting member 30 and the recording element substrate 10 included in each ejection module 200. Further, a flow passage for recovering (recirculating) a part or the whole of the liquid supplied to the recording element 15 to the first flow passage member 50 is formed. Here, the common supply flow passage 211 of each color is connected to the negative-pressure control unit 230 (high pressure side) of a corresponding color through the liquid supply unit 220, and the common recovery flow passage 212 is connected to the negative-pressure control unit 230 (low pressure side) through the liquid supply unit 220. The negative-pressure control unit 230 generates differential pressure (pressure difference) between the common supply flow passage 211 and the common recovery flow passage 212. Therefore, in the liquid ejection head in which flow passages are connected as illustrated in FIGS. 6 and 7 according to the present embodiment, a flow flowing through the common supply flow passage 211, the individual supply flow passage 213*a*, the recording element substrate 10, the individual recovery flow passage 214*b*, and the common recovery flow passage 212 in this order occurs for each color.

Description of Ejection Module

Figure 8A:
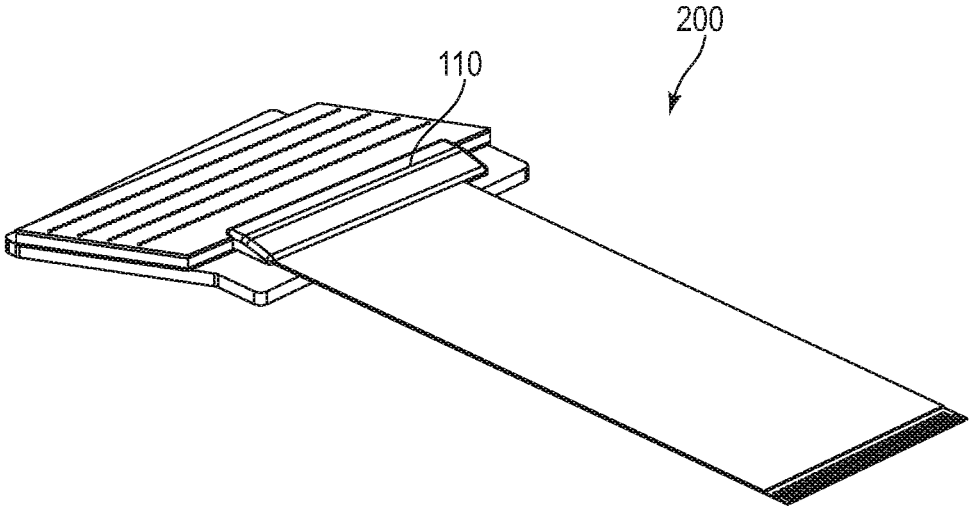
FIGS. 8A and 8B are a perspective view and an exploded perspective view of an ejection module of the liquid ejection head illustrated in FIGS. 3A and 3B.
Figure 8B:
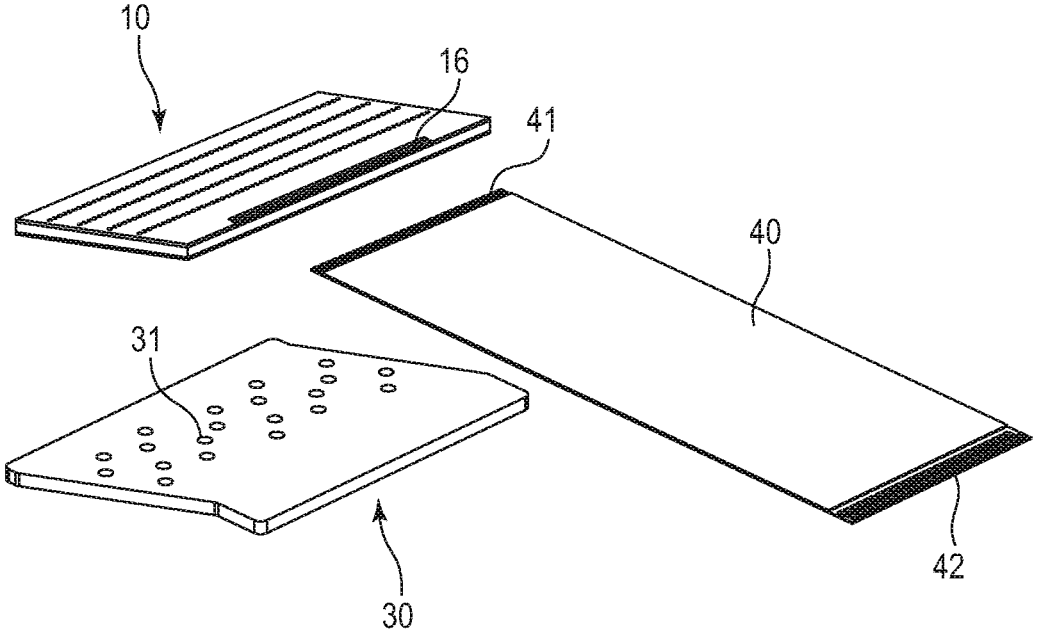

A perspective view of one ejection module 200 is illustrated in FIG. 8A, and an exploded view thereof is illustrated in FIG. 8B. As a method of manufacturing the ejection module 200, first, the recording element substrate 10 and the flexible wiring substrate 40 are bonded on the supporting member 30 provided with liquid communication ports 31 in advance. Thereafter, a terminal 16 on the recording element substrate 10 and a terminal 41 on the flexible wiring substrate 40 are electrically connected to each other by wire bonding, and then a wire bonding part (electric connection part) is covered with the sealing member 110 to be sealed. A terminal 42 of the flexible wiring substrate 40 on the side opposite to the recording element substrate 10 is electrically connected to a connecting terminal 93 (see FIG. 4) of the electrical wiring substrate 90. Since the supporting member 30 is a support that supports the recording element substrate 10, and also is a flow passage member for fluidly communicating the recording element substrate 10 with the flow passage member 210, a supporting member, which has high flatness and can be joined to the recording element substrate with sufficiently high reliability, is preferably used. As the material, for example, alumina or a resin material can be preferably used.

Description of Structure of Recording Element Substrate

Figure 9A:
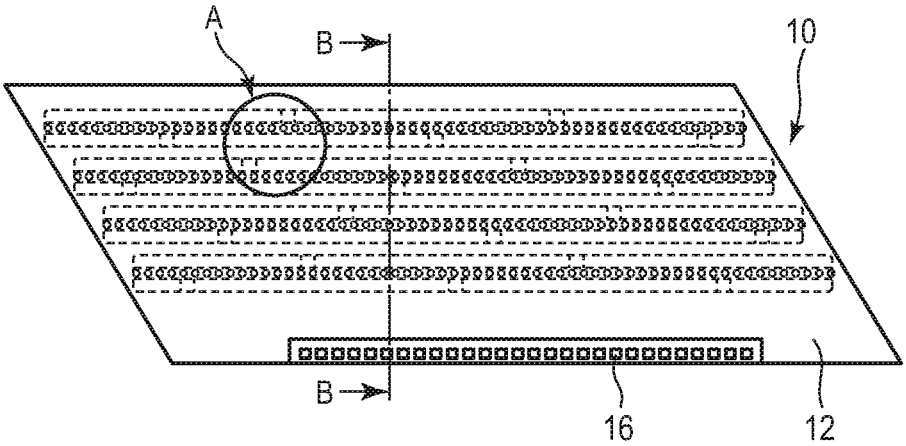
FIGS. 9A, 9B and 9C are a plan view, an enlarged plan view, and a rear view of a recording element substrate of the liquid ejection head illustrated in FIGS. 3A and 3B.
Figure 9B:
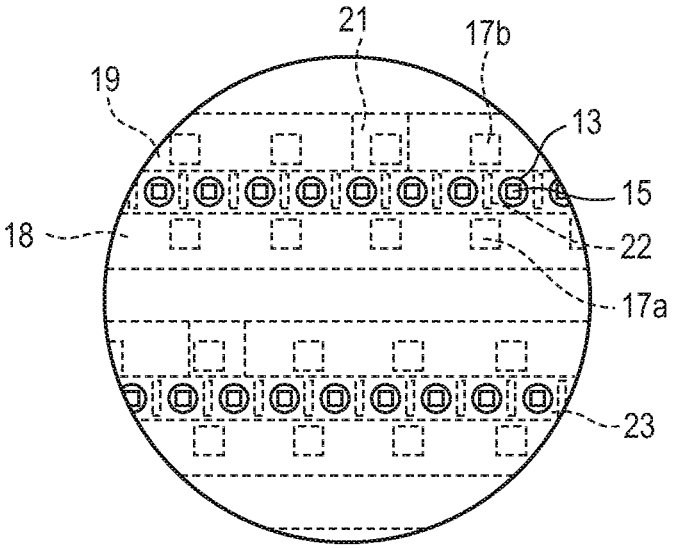
Figure 9C:
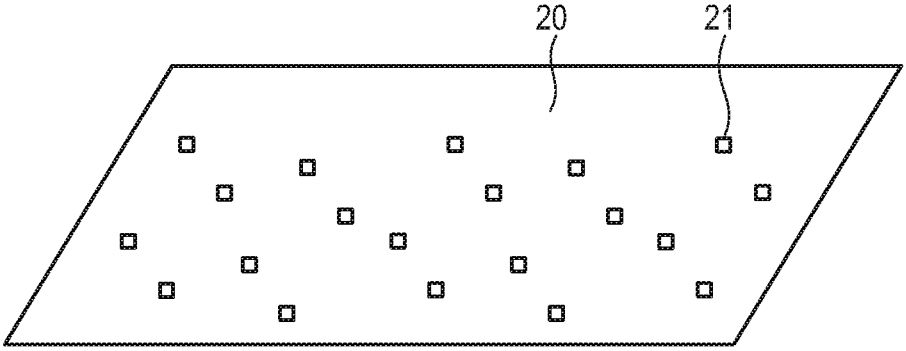

The configuration of the recording element substrate 10 in the present embodiment will be described. FIG. 9A illustrates a plan view of a surface of the recording element substrate 10 on a side on which the ejection port 13 is formed, FIG. 9B illustrates an enlarged view of a part indicated by A in FIG. 9A, and FIG. 9C illustrates the top view of the back surface of FIG. 9A. As illustrated in FIG. 9A, four ejection port lines corresponding to respective ink colors are formed on the ejection port forming member 12 of the recording element substrate 10. Thereafter, the direction in which the ejection port line including the plurality of ejection ports 13 disposed therein is extended is called "ejection port line direction".

As illustrated in FIG. 9B, the recording element 15 which is a heat generating element for foaming a liquid by thermal energy is disposed at a position corresponding to each ejection port 13. The pressure chamber 23 provided with the recording element 15 inside is partitioned by a partition wall 22. The recording element 15 is electrically connected to the terminal 16 in FIG. 9A by electric wiring (not illustrated) provided on the recording element substrate 10. The recording element 15 generates heat based on pulse signals input from a control circuit of the liquid ejection apparatus 1000 through the electrical wiring substrate 90 (FIG. 4) and the flexible wiring substrate 40 (FIGS. 8A and 8B), and boils the liquid. The liquid is ejected from the ejection port 13 by the foaming force by the boiling. As illustrated in FIG. 9B, a liquid supply path 18 is extended on one side and a liquid recovery path 19 is extended on the other side along each ejection port line. The liquid supply path 18 and the liquid recovery path 19 are flow passages extending in the ejection port line direction provided in the recording element substrate 10, and communicate with the ejection port 13 through a supply port 17*a* and a recovery port 17*b*, respectively. A plurality of supply ports 17*a* which are through-holes penetrating the substrate is provided to form a supply port line along the line of ejection ports 13, and a plurality of recovery ports 17*b* penetrating the substrate forms a recovery port line along the ejection port line. The liquid supply path 18 as a common path for supplying liquid to the supply port line is formed along the supply port line, and the liquid recovery path 19 as a supply recovery path for recovering liquid from the recovery port line is formed along the recovery port line.

Figure 11:
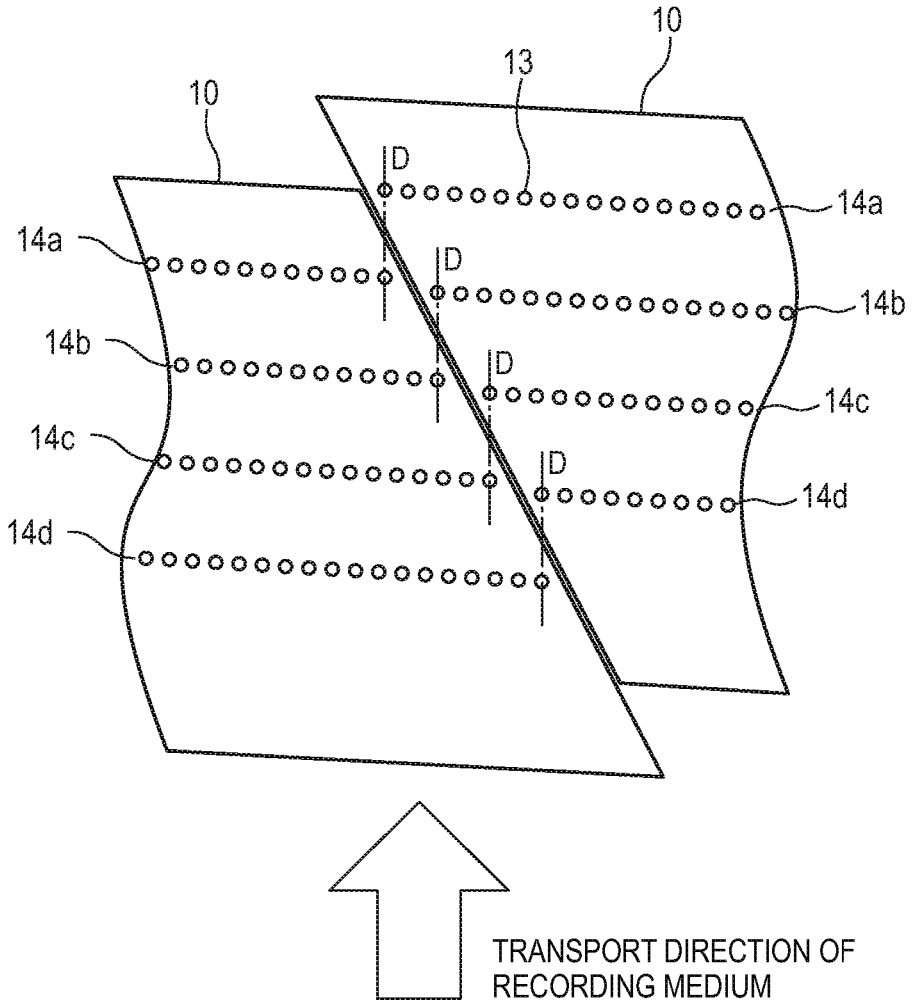
FIG. 11 is an enlarged plan view of a main part of two adjacent recording element substrates of the liquid ejection head illustrated in FIGS. 3A and 3B.

As illustrated in FIG. 9C and FIG. 11, a sheet-like lid member 20 is laminated on the back surface of the surface of the recording element substrate 10 where the ejection port 13 is formed, and the lid member 20 is provided with a plurality of openings 21 communicating with the liquid supply path 18 and the liquid recovery path 19 to be described later. In the present embodiment, the lid member 20 is provided with three openings 21 for one liquid supply path 18 and two openings 21 for one liquid recovery path 19. As illustrated in FIG. 9B, respective openings 21 of the lid member 20 communicate with a plurality of communication ports 51 illustrated in FIG. 5A.

Figure 10:
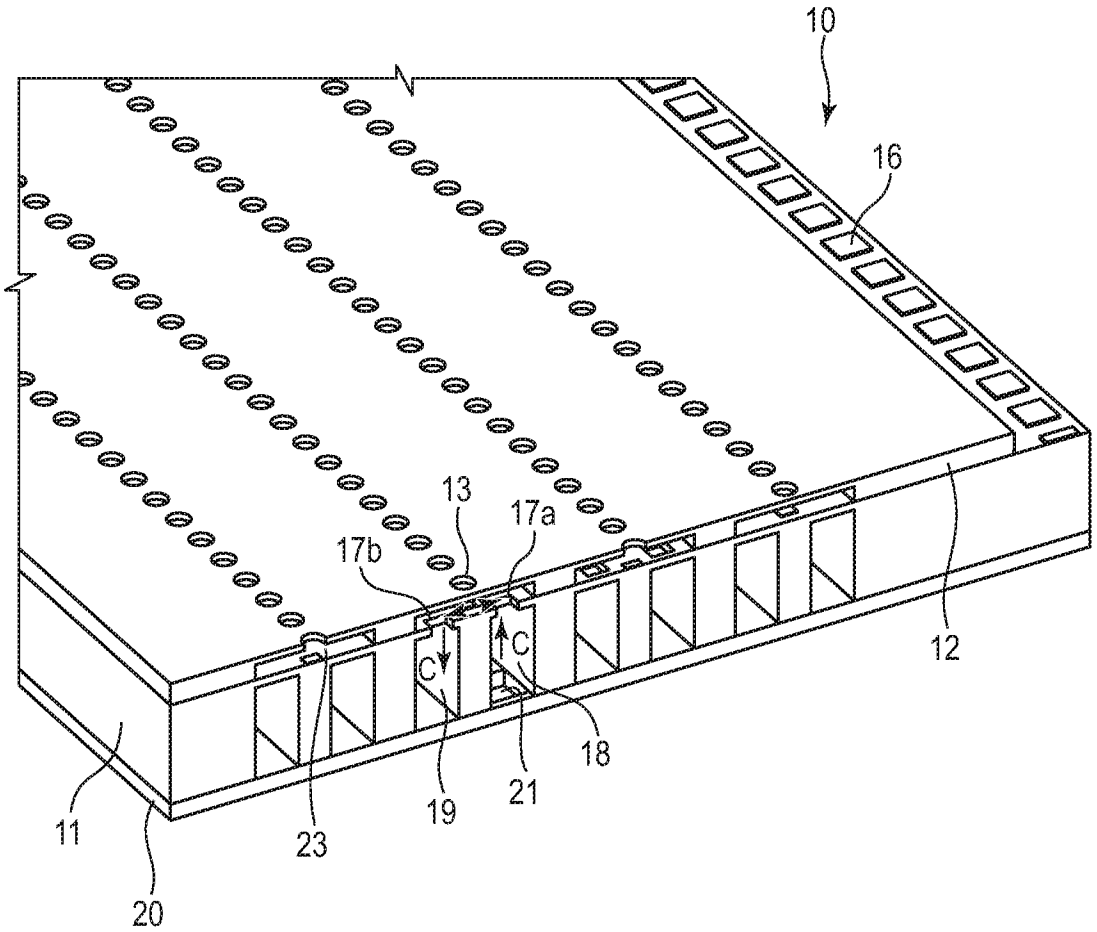
FIG. 10 is a perspective view of a partially cutout part of the liquid ejection head illustrated in FIGS. 3A and 3B.

As illustrated in FIG. 10, the lid member 20 has a function as a lid for forming a part of walls of the liquid supply path 18 and the liquid recovery path 19 formed on a substrate 11 of the recording element substrate 10. The lid member 20 preferably has sufficient corrosion resistance to the liquid, and high accuracy is required for the opening shape and the opening position of the opening 21 from the viewpoint of color mixing prevention. Therefore, it is preferable that a photosensitive resin material or a silicon plate is used as the material of the lid member 20, and the openings 21 are provided by a photolithographic process. In this way, the lid member 20 converts the pitch of the flow passages depending on the openings 21, preferably has a smaller thickness if pressure loss is taken into consideration, and is preferably made of a film-like member.

Next, the flow of the liquid in the recording element substrate 10 will be described. FIG. 10 is a perspective view illustrating the cross sections of the recording element substrate 10 and the lid member 20 on the B-B surface in FIG. 9A. The substrate 11 formed of Si and the ejection port forming member 12 formed of a photosensitive resin are laminated on the recording element substrate 10, and the lid member 20 is joined to the back surface of the substrate 11. The recording element 15 is formed on one surface side of the substrate 11 (FIGS. 9A to 9C), and a groove constituting the liquid supply path 18 and the liquid recovery path 19 extending along the ejection port line is formed on the back surface side. The liquid supply path 18 and the liquid recovery path 19 formed of the substrate 11 and the lid member 20 are respectively connected to the common supply flow passage 211 and the common recovery flow passage 212 in the flow passage member 210, and differential pressure is generated between the liquid supply path 18 and the liquid recovery path 19. When a liquid is ejected from a plurality of ejection ports 13 of the liquid ejection head 3 and recording is performed, a circulation flow flows at the ejection port where no ejection operation is performed. In the circulation flow, the liquid in the liquid supply path 18 provided in the substrate 11 flows to the liquid recovery path 19 through the supply port 17*a*, the pressure chamber 23 and the recovery port 17*b* by the differential pressure (flow indicated by arrow C in FIGS. 9A to 9C). By this flow, viscosity-increased ink, bubbles, and foreign matters generated by evaporation from the ejection port 13 in the ejection port 13 and the pressure chamber 23 where recording is suspended can be recovered to the liquid recovery path 19. Additionally, the increase in viscosity of the ink in the ejection port 13 and the pressure chamber 23 can be suppressed. The liquid recovered to the liquid recovery path 19 is recovered in order of the communication ports 51, individual recovery flow passages 214 and the common recovery flow passages 212 in the flow passage member 210 through the openings 21 of the lid member 20 and the liquid communication port 31 of the supporting member 30 (see FIG. 8B). The liquid recovered to the liquid recovery path 19 is finally recovered to the supply path of the liquid ejection apparatus 1000.

That is, the liquid supplied from the liquid ejection apparatus body to the liquid ejection head 3 flows in the following order and is supplied and recovered. First, the liquid flows into the liquid ejection head 3 from the liquid connecting part 111 of the liquid supply unit 220. Thereafter, the liquid is supplied in the order of the joint rubber 100, the communication port 72 and the common flow passage groove 71 provided in the third flow passage member, the common flow passage groove 62 and the communication port 61 provided in the second flow passage member, and the individual flow passage groove 52 and the communication port 51 provided in the first flow passage member. Thereafter, the liquid is supplied to the pressure chamber 23 through the liquid communication port 31 provided in the supporting member 30, the opening 21 provided in the lid member, the liquid supply path 18 and the supply port 17*a* provided in the substrate 11 in this order. Among the liquid supplied to the pressure chamber 23, the liquid not ejected from the ejection port 13 flows through the recovery port 17*b* and the liquid recovery path 19 provided in the substrate 11, the opening 21 provided in the lid member, and the liquid communication port 31 provided in the supporting member 30 in this order. Thereafter, the liquid flows through the communication port 51 and the individual flow passage groove 52 provided in the first flow passage member, the communication port 61 and the common flow passage groove 62 provided in the second flow passage member, the common flow passage groove 71 and the communication port 72 provided in the third flow passage member 70, and the joint rubber 100 in this order. Thereafter, the liquid flows to the outside of the liquid ejection head 3 from the liquid connecting part 111 provided in the liquid supply unit. In the form of the first circulation path illustrated in FIG. 2, the liquid flowing in from the liquid connecting part 111 is supplied to the joint rubber 100 after passing through the negative-pressure control unit 230. In the form of a second circulation path illustrated in FIG. 2, the liquid recovered from the pressure chamber 23 passes through the joint rubber 100 and then flows from the liquid connecting part 111 to the outside of the liquid ejection head through the negative-pressure control unit 230.

Figure 27A:
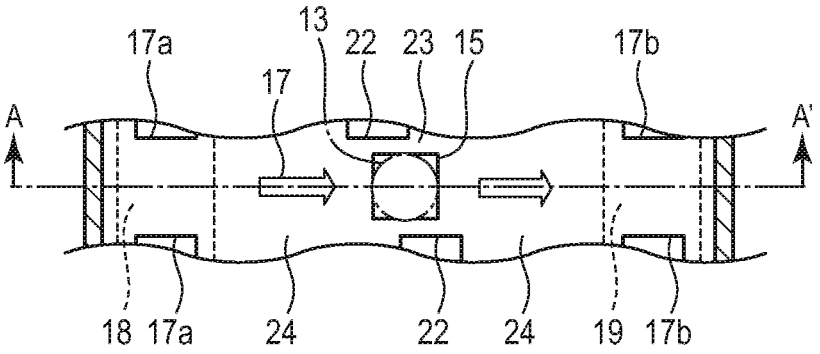
FIGS. 27A, 27B and 27C are diagrams illustrating a state of a flow, in the vicinity of an ejection port, of an ink flow flowing in the liquid ejection head according to the first embodiment.
Figure 27B:
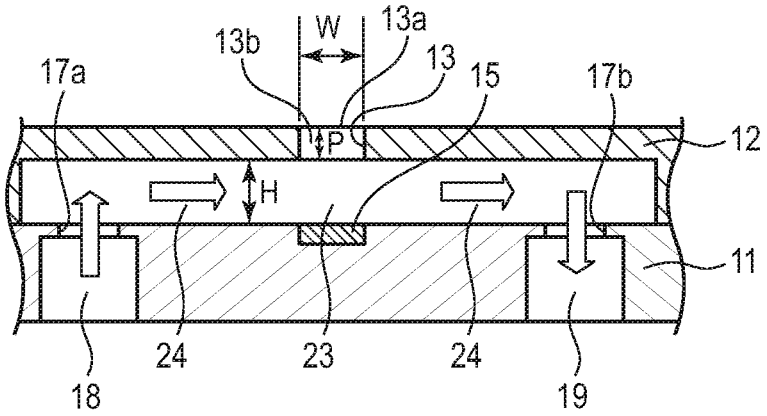
Figure 27C:
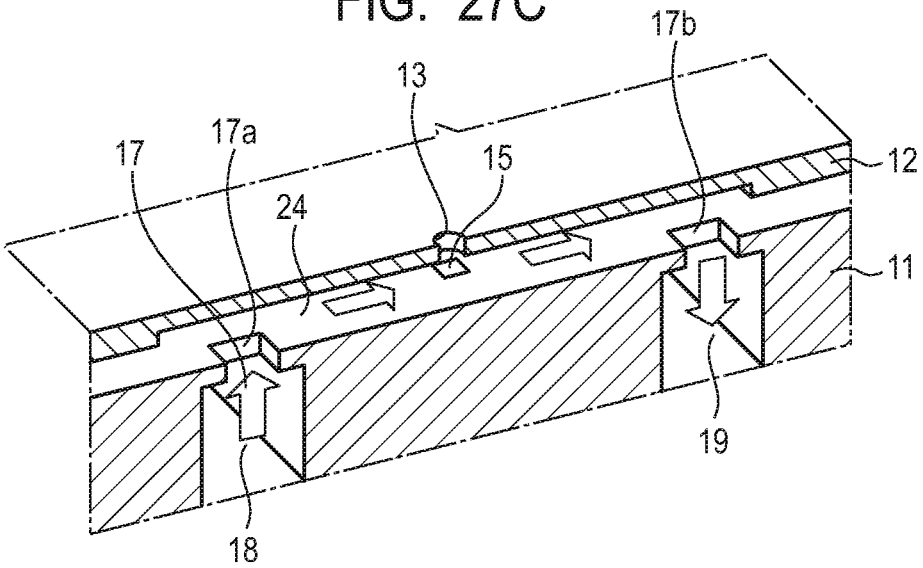

As illustrated in FIG. 2, in the present embodiment, a part of the liquid flowing in from one end of the common supply flow passage 211 of the liquid ejection unit 300 is ejected from the other end of the common supply flow passage 211 without flowing in the individual supply flow passage 213. However, without being limited thereto, for example, all the liquids may flow into the individual supply flow passage without providing an ejection port at the other end of the common supply flow passage. The number of inlets of the common supply flow passage is not limited to one, and the other end may be provided as an inlet. FIGS. 27A to 27C are views illustrating the structure of the ejection port and an ink flow passage in the vicinity of the ejection port in the liquid ejection head according to the present embodiment. FIG. 27A is a plan view of an ink flow passage viewed from the side where ink is ejected, FIG. 27B is a cross sectional view taken along line A-A' in FIG. 27A, and FIG. 27C is a perspective view of an A-A' cross section in FIG. 27A.

As illustrated in FIGS. 27A to 27C, ink flows 17 are generated in the pressure chamber 23 provided with the recording element 15 on the substrate 11 of the liquid ejection head and the flow passage 24 before and after the pressure chamber 23 by the above-described circulation of ink. That is, the ink is supplied from the liquid supply path (supply flow passage) 18 through the supply port 17*a* provided on the substrate 11 by a differential pressure generating ink circulation. The ink flows through a supply-side flow passage 24, the pressure chamber 23, and a recovery-side flow passage 24, and a flow to the liquid recovery path (recovery flow passage) 19 through the recovery port 17*b* is generated.

When the ink is not ejected, together with the flow of the ink described above, a space from the recording element (energy generating element) 15 to the ejection port 13 above it is filled with the ink, and a meniscus of ink (ink interface 13*a*) is formed in the vicinity of an end on the ejection direction side of the ejection port 13. Although the ink interface is represented by a straight line (plane) in FIG. 27B, its shape is determined according to a member forming the wall of the ejection port 13 and the ink surface tension, and is usually a concave or convex curve (curved surface). The ink interface is represented by a straight line in order to simplify illustration. By driving an electrothermal conversion element (heater) which is the energy generating element 15 in a state where the meniscus is formed, air bubbles are generated in the ink by utilizing the generated heat, and the ink can be ejected from the ejection port 13. Further, in the present embodiment, a heater is applied as an energy generating element, but the present disclosure is not limited thereto, and various energy generating elements such as piezoelectric elements can be applied, for example. In the present embodiment, the speed of the ink flow flowing through the supply-side flow passage 24 is, for example, about 0.1 to 100 mm/s, and even if the ejection operation is performed in a state where the ink flows, the influence on the landing accuracy and the like can be made relatively small.

P, W, H Relationships

In the liquid ejection head of the present embodiment, the relationship between the height H of the supply-side flow passage 24, the thickness P of an orifice plate (ejection port forming member 12), and the length (diameter) W of the ejection port is defined as described below. In FIG. 27B, the upstream-side height of the supply-side flow passage 24 is indicated as H at the lower end (communication part between the ejection port part and the flow passage) of the part (hereinafter referred to as ejection port part 13*b*) having the thickness P of the orifice plate of the ejection port 13. The length of the ejection port part 13*b* is indicated as P. Further, the length of the ejection port part 13*b* in the flow direction of the liquid in the flow passage 24 is indicated as W. In the liquid ejection head of the present embodiment, H is 3 to 30 μm, P is 3 to 30 μm, and W is 6 to 30 μm. The ink has a nonvolatile solvent concentration of 30% and a coloring material concentration of 3%, and its viscosity is adjusted to 0.002 to 0.01 Pa·s.

Figure 28A:
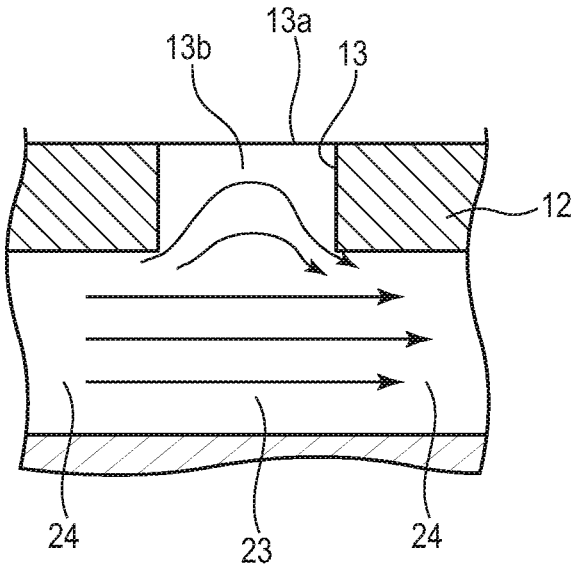
FIGS. 28A and 28B are diagrams illustrating a state of a liquid flowing in a pressure chamber 23 and an ejection port part 13*b*.
Figure 28B:
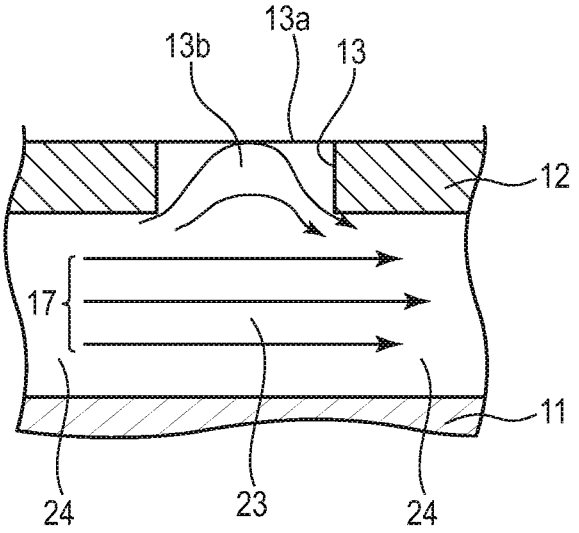

In the present embodiment, the following is performed in order to suppress the increase in viscosity of ink due to the evaporation of ink from the ejection port 13. FIG. 28A shows the flow state of the ink flow 17 in the ejection port 13, the ejection port part 13*b*, and the flow passage 24 when the ink flow 17 (see FIGS. 27A to 27C) of the ink flowing in the flow passage 24 and the pressure chamber 23 of the liquid ejection head is in a steady state. In FIG. 28A, the length of the arrow does not indicate the magnitude of the speed of the ink flow. FIG. 28B shows a flow when ink flows in from the liquid supply path 18 to the flow passage 24 at a flow rate of $1.26\times10^{-4}$ ml/min in the liquid ejection head having a height H of the supply-side flow passage 24 of 14 μm, a length P of the ejection port part 13*b* of 10 μm and a length (diameter) W of the ejection port of 17 μm.

In the present embodiment, the height H [μm] of the flow passage 24, the length P [μm] of the ejection port part 13*b*, and the length W [μm] of the ejection port part 13*b* in the ink flowing direction has a relationship satisfying the following Expression (1).

$$H^{-0.34}\times P^{-0.66}\times W>1.5 \quad (1)$$

When this condition is satisfied, as illustrated in FIG. 28A, the ink flow 17 flowing in the flow passage 24 flows into the ejection port part 13*b*, reaches at least a half of the thickness of the orifice plate of the ejection port part 13*b*, and then returns to the flow passage 24 again. The ink returned to the flow passage 24 flows through the liquid recovery path 19 to the common recovery flow passage 212 described above. That is, at least a part of the ink flow 17 reaches a position of ½ or more of the ejection port part 13*b* in a direction toward the ink interface 13*a* from the pressure chamber 23, and then returns to the flow passage 24. The flow can suppress the increase in viscosity of the ink in many regions in the ejection port part 13*b*. Since such an ink flow in the liquid ejection head is generated, the ink not only in the flow passage 24 but also in the ejection port part 13*b* can flow out to the flow passage 24. As a result, an increase in viscosity of ink and an increase in the ink coloring material concentration at the ejection port 13 and the ejection port part 13*b* can be suppressed. The liquid droplets of the ink ejected from the ejection port are ejected in a state where the ink of the ejection port part 13*b* and the ink of the pressure chamber 23 (flow passage 24) are mixed. In the present embodiment, it is preferable that the ratio of the ink of the pressure chamber 23 (flow passage 24) is larger among the ejected liquid droplets. For example, it is preferable that air bubbles generated for ejection communicate with the ambient air. In particular, the liquid ejection head having H of 20 μm or less, P of 20 μm or less, and W of 30 μm or less is preferably used because it can perform higher-definition recording.

In order to further suppress the increase in viscosity of the ink in the ejection port part 13*b*, it is preferable that the flow of the ink flowing into the ejection port part 13*b* reaches closer to the ink interface 13*a* on the ejection port surface, as illustrated in FIG. 28B. This is achieved by satisfying the following Expression (2).

$$H^{-0.34}\times P^{-0.66}\times W>1.7 \quad (2)$$

In the case of a configuration satisfying Expression (2), since the ink flows further to the vicinity of the meniscus of the ejection port 13, the increase in viscosity of the ink near the ink interface 13*a* can be suppressed as compared with the case of FIG. 28A. Thus, the number of preliminary ejections can be suppressed, and preliminary ejections during recording on the recording medium can be eliminated as described later.

Thus, by circulating the ink inside and outside the pressure chamber 23 as in the present embodiment, an increase in viscosity of the ink inside the pressure chamber 23 and the ejection port part 13*b* can be suppressed, and as a result, the number of preliminary ejections can be reduced. In particular, since the increase in viscosity of ink can be further suppressed by satisfying Expression (1) and more preferably Expression (2), the number of preliminary ejections can be further reduced.

The shapes of the ejection port 13 and the ejection port part 13*b* are not limited to the shapes illustrated in FIGS. 28A and 28B. For example, as illustrated in FIGS. 25A and 25B and 26A and 26B, it is also applicable to a ejection port shape in which a plurality of projections extend from the periphery of the ejection port 13 toward the center of the ejection port 13. In FIGS. 25A, 25B and FIGS. 26A and 26B, plan views and cross-sectional views of a nozzle part around the ejection port 13 are respectively illustrated. By providing projections in the ejection port 13 in this way, the satellite and mist accompanying the liquid droplets ejected can be suppressed. In the case of the ejection ports having such a shape, W is a part having a maximum ejection port diameter as illustrated in FIGS. 25A, 25B and FIGS. 26A and 26B.

The present disclosure can be applied even when the ejection port part 13*b* has a tapered shape such that the cross-sectional area is enlarged or reduced from the pressure chamber 23 to the ejection port 13 or has a stepped shape.

Figure 25A:
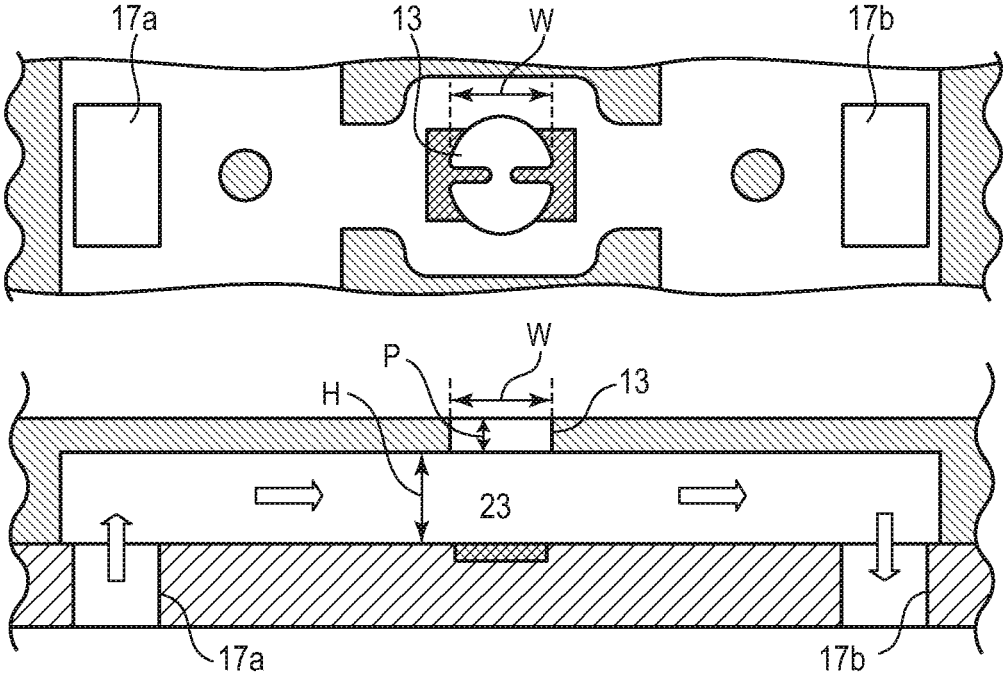
FIGS. 25A and 25B are plan views illustrating the shape of an ejection port in the first embodiment and sectional views illustrating a state of ink circulation in the vicinity of the ejection port.
Figure 25B:
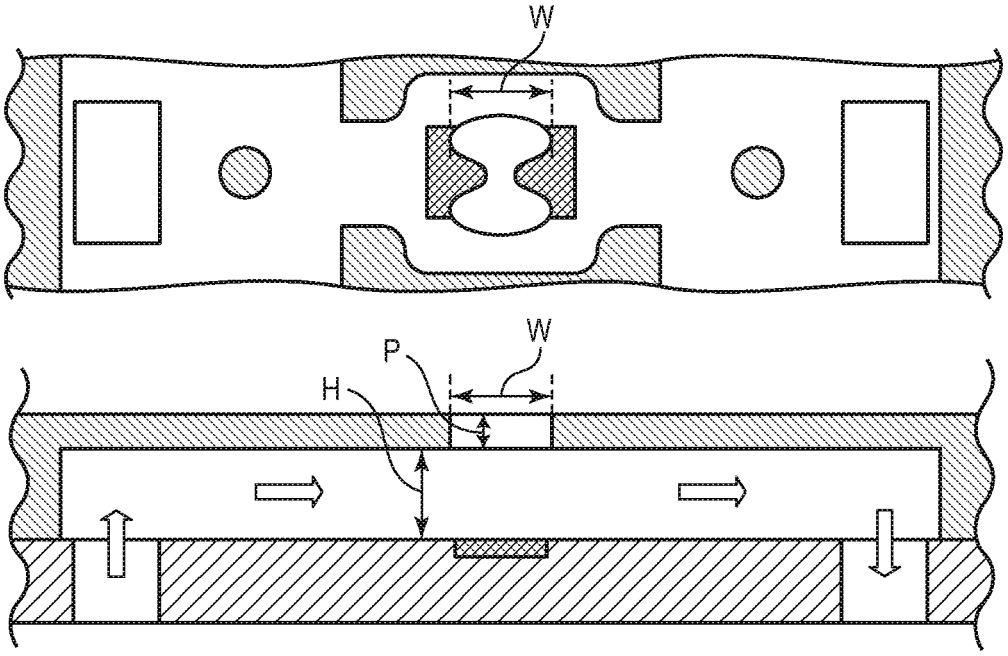
Figure 26A:
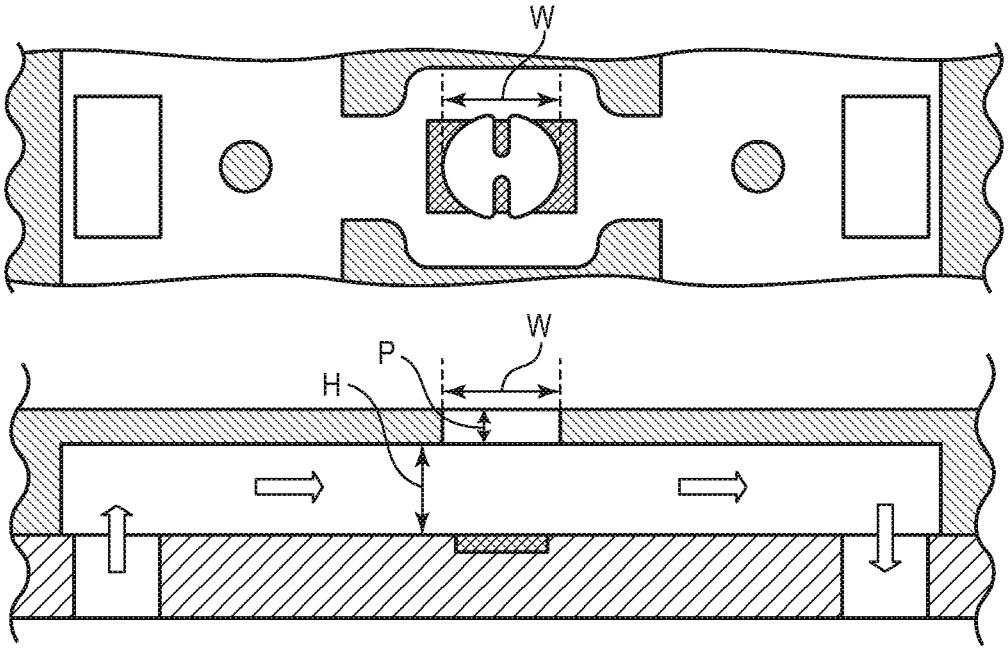
FIGS. 26A and 26B are plan views illustrating the shape of an ejection port and sectional views illustrating a state of ink circulation in the vicinity of the ejection port, as a modification example of the first embodiment.
Figure 26B:
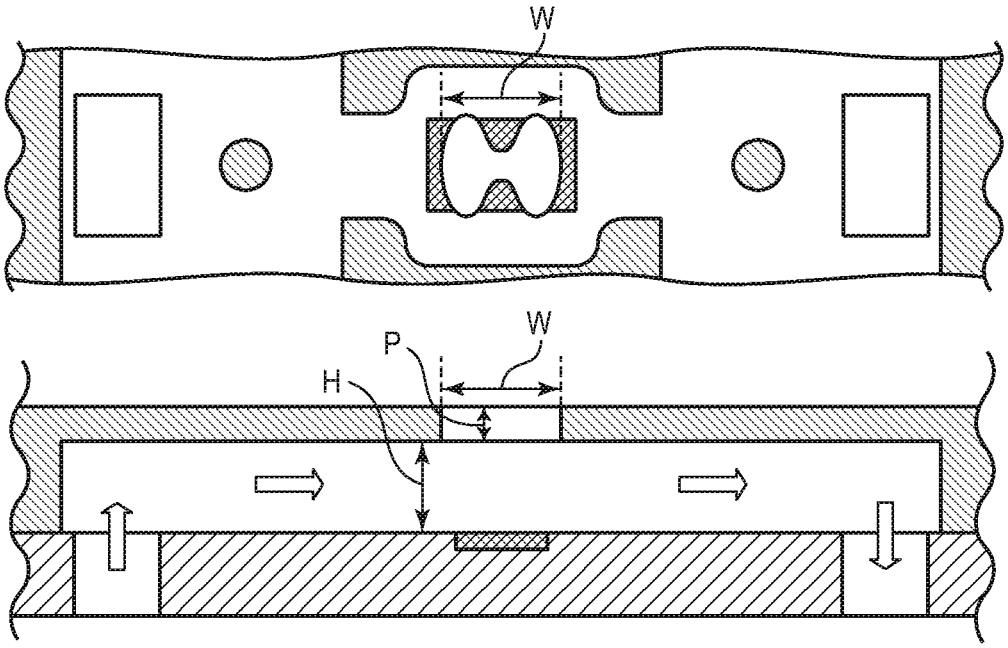

FIGS. 25A and 25B illustrate an example in which two projections are formed along a circulation flow in the ejection port 13, and FIGS. 26A and 26B illustrate an example in which two projections extend in a direction intersecting (orthogonal to) the flow of the circulation flow.

Description of Positional Relationship Between Recording Element Substrates

FIG. 11 is a plan view partially enlarging and illustrating the adjacent parts of the recording element substrates in two adjacent ejection modules. As illustrated in FIGS. 9A to 9C, in the present embodiment, a recording element substrate of an approximately parallelogram shape is used. As illustrated in FIG. 11, ejection port lines (14*a*-14*d*) having ejection ports 13 disposed in each recording element substrate 10 are disposed so as to incline at a fixed angle with respect to the conveying direction of the recording medium. Consequently, on the ejection lines in the adjacent parts of the recording element substrates 10, at least one ejection port is overlapped in the conveying direction of the recording medium.

In FIG. 11, two ejection ports on the D line are in a mutually overlapped relationship. By such arrangement, even in a case where the position of the recording element substrate 10 is shifted slightly from the predetermined position, the black stripe and void of the recording image can be made inconspicuous by the driving control of the overlapping ejection ports. Even in a case where a plurality of recording element substrates 10 are not arranged in staggered manner but arranged on a straight line (inline), an increase in the length of the liquid ejection head 3 in the conveying direction of the recoding medium can be suppressed by the configuration illustrated in FIG. 11. Further, countermeasures can be taken against black stripes and void in the connecting portion between the recording element substrates 10. Although the main plane of the recording element substrate is a parallelogram in the present embodiment, the present disclosure is not limited to this, and the configuration of the present disclosure can be preferably applied even in a case where, for example, a recording element substrate of a rectangle, a trapezoid or other shapes is used.

Figure 23A:
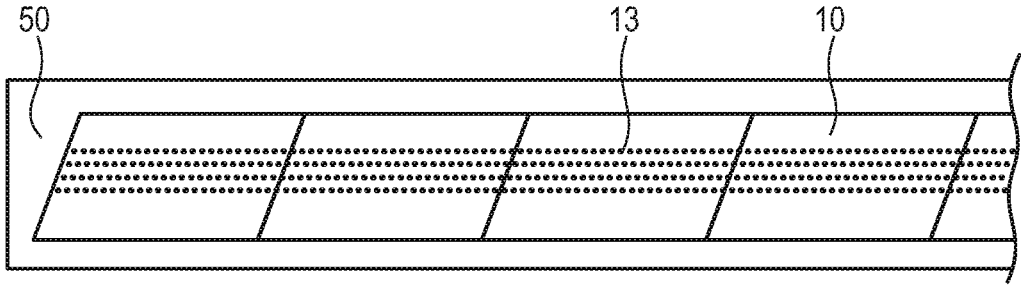
FIGS. 23A and 23B are diagrams illustrating the arrangement of a recording element substrate of a liquid ejection head, as a modification example of the first embodiment.
Figure 23B:
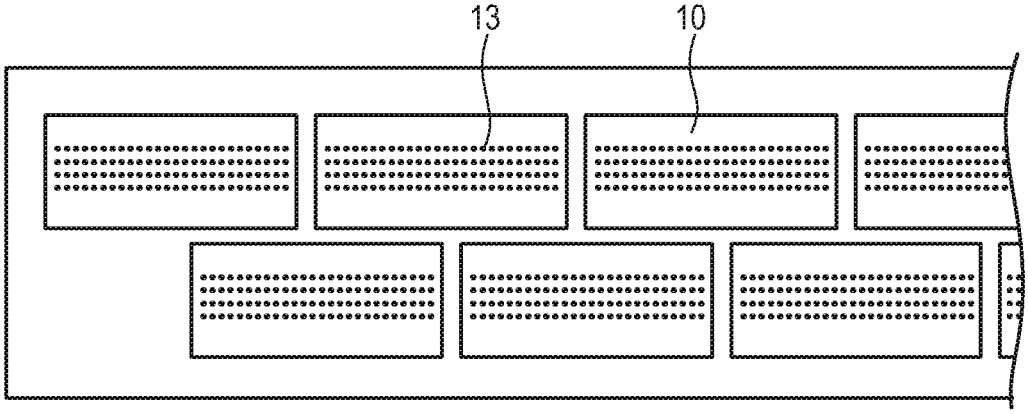
Figure 24:
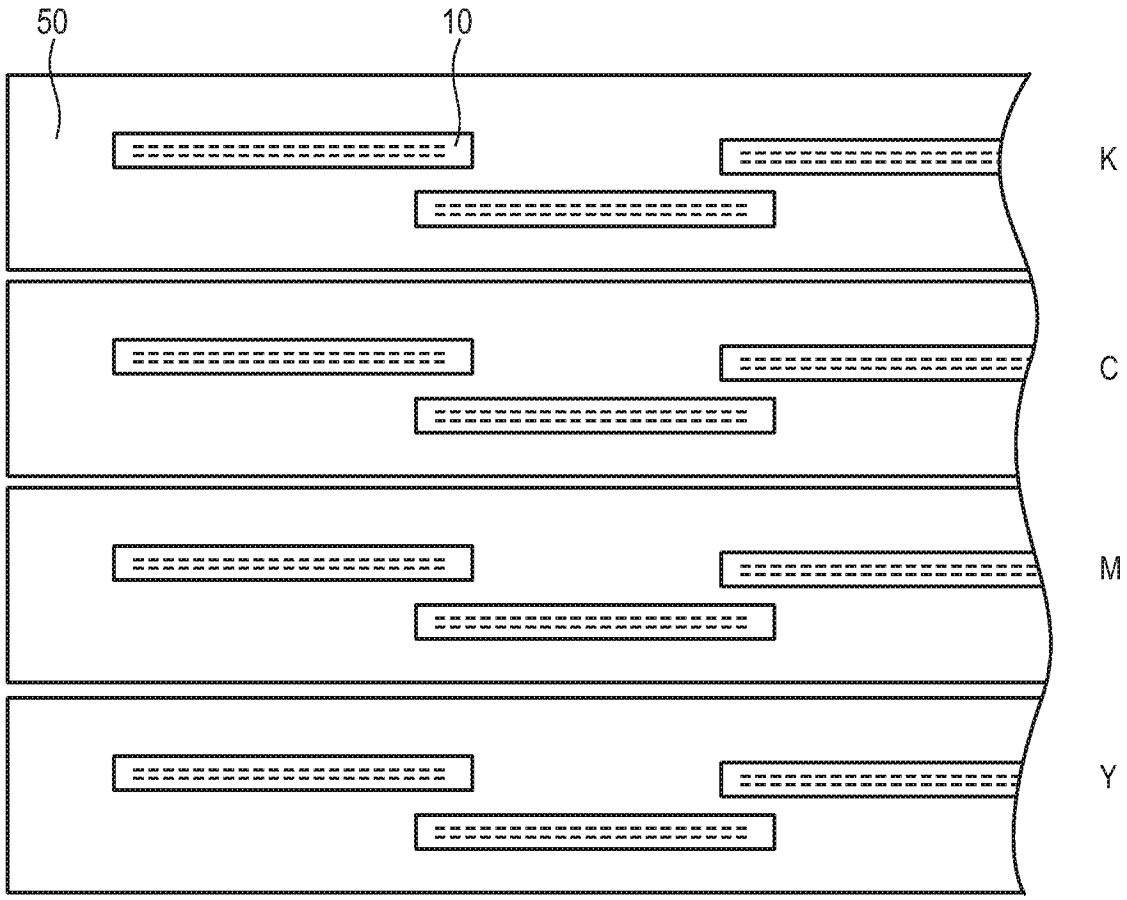
FIG. 24 is a diagram illustrating the arrangement of a recording element substrate of a liquid ejection head, as a modification example of the first embodiment.

Specifically, the configuration of the present disclosure can be applied to an example in which parallelogram recording element substrates 10 are disposed in a line as illustrated in FIG. 23A, and an example in which rectangular recording element substrates are arranged in a staggered manner as illustrated in FIG. 23B. Further, as illustrated in FIG. 24, the configuration of the present disclosure can be applied to an aspect in which rectangular recording element substrates 10 each discharging one type of ink are arranged in a staggered manner. In this case, in order to configure a color liquid ejection apparatus, it is necessary to provide four liquid ejection heads. In this way, liquid ejection heads in various forms can be applied, as long as they are of the form in which a liquid circulates inside and outside the pressure chamber 23.

Description of Temperature Adjustment

Figure 20A:
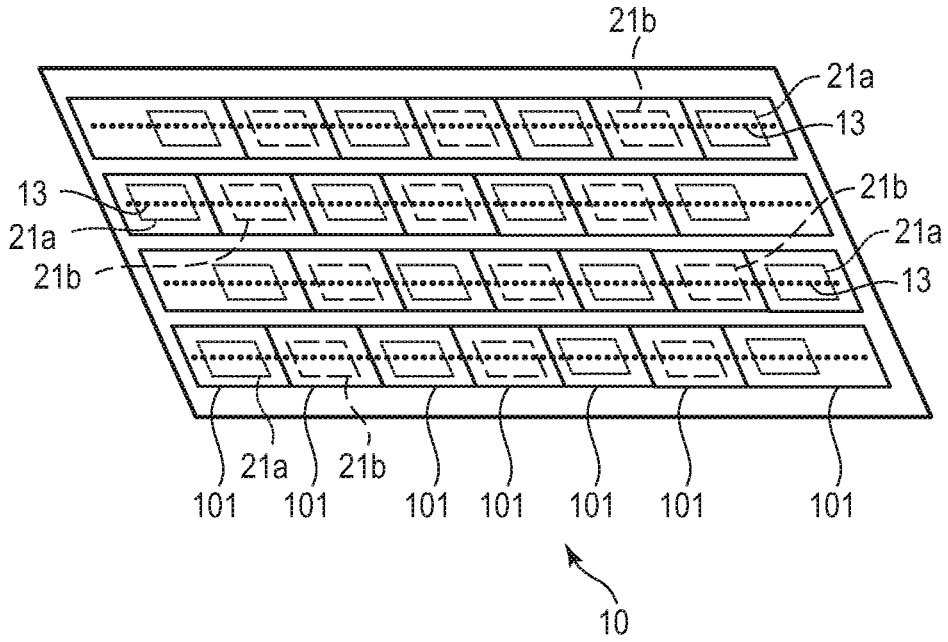
FIGS. 20A and 20B are diagrams illustrating the arrangement of a temperature sensor and a temperature adjusting heater of the recording element substrate of the first embodiment.
Figure 20B:
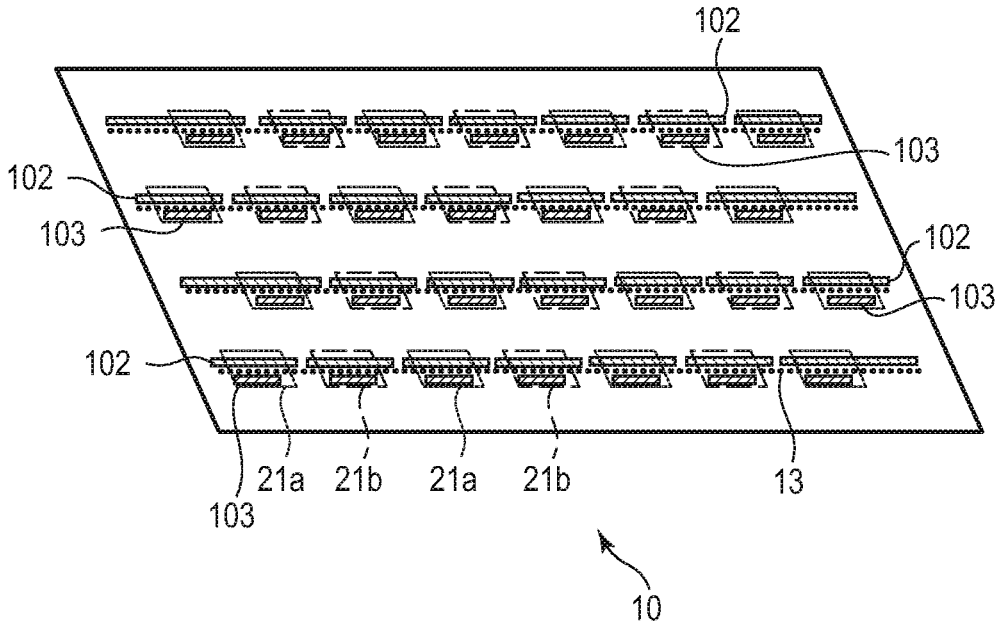

FIGS. 20A and 20B are diagrams schematically illustrating the positional relationship between the opening 21, a heater 102, and a temperature sensor 103 measuring the temperature of a liquid (substrate), in the recording element substrate according to the first embodiment. FIG. 20A illustrates, in a transparent manner, the ejection port forming member 12 (FIG. 10) in order to describe the arrangement of the openings 21 along the ejection port line in which ejection ports 13 are disposed on the recording element substrate 10. As illustrated in FIGS. 9A to 9C and FIG. 10, the opening 21 is an opening, formed on the back surface of the recording element substrate 10, through which a liquid is conducted, and is disposed for each of the liquid supply path 18 and the liquid recovery path 19 extending along the ejection port line on both sides. In FIGS. 20A and 20B, respective openings 21 are arranged on straight lines for simplifying illustration and description. The opening 21*a* is an opening, disposed in the liquid supply path 18 (FIGS. 9A to 9C), for supplying liquid from the outside of the recording element substrate 10 to the liquid supply path 18. The opening 21*b* is disposed in the liquid recovery path 19 (FIGS. 9A to 9C), and recovers ink in the liquid recovery path 19 to the outside of the recording element substrate 10. The sizes of the respective openings 21 in FIGS. 20A and 20B are schematically illustrated, and the number of openings 21 is schematically indicated without specifying three for one liquid supply path 18 and two for one liquid recovery path 19 in FIG. 10.

FIG. 20B schematically illustrates the state of removing the ejection port forming member 12 from FIG. 20A. The positional relationship of the heater 102 (and the line of heaters) and the temperature sensor 103 (and the line of temperature sensors) relative to the positions of the openings 21*a* and 21*b* along the ejection port lines is illustrated. As will be described below, the heater 102 is provided separately from the recording element 15 (FIGS. 9A to 9C) for ejection, and is used to warm the ink to be ejected and/or the recording element substrate (to adjust temperature (hereinafter, temperature adjustment)). The numbers of openings 21*a* and 21*b* are an example, and two openings 21*a* may be used for one liquid supply path 18 and one opening 21*b* may be used for one liquid recovery path 19. The number of openings 21*a*, 21*b* may be the same.

In the present embodiment, as illustrated in FIG. 20A, areas near the opening 21*a* or the opening 21*b* are defined as temperature adjustment areas 101. The temperature sensor 103 and the temperature adjusting heater 102 are disposed in each of these areas as illustrated in FIG. 20B. Specifically, the temperature adjusting heater 102 and the temperature sensor 103 are provided around the recording element 15 which is an element for ejection at a distance not affecting each other. As a specific example of the temperature sensor, a diode sensor or the like can be cited.

The shape of the temperature sensor 103 is long in the direction of the ejection port line in FIG. 20B, but the shape is not particularly limited and may be circular, square, or the like. The temperature adjusting heater 102 is not limited to the form illustrated in FIG. 20B. For example, in a case where the recording element 15 for ejection is a heat generating element, temperature adjustment may be performed by inputting to the recording element 15 a pulse current which is so shorter than that for ejection that liquid is not to be ejected and utilizing the recording element 15 as a temperature adjusting heater. Further, the temperature adjusting heater 102 and the temperature sensor 103 may not be provided for each temperature adjustment area 101, and at least one temperature adjusting heater 102 may be provided on the recording element substrate 10. The temperature adjusting heater 102 may not be in an individual form, and may be configured to adjust the temperature by disposing, for example, a conductive member (wiring member) on the recording element substrate 10.

The temperature adjustment control of the liquid ejection head will be described below, but the example illustrated below is an example, and the present disclosure can be applied to various forms of temperature adjustment controls, without being limited thereto. In each area 101, when the temperature sensor 103 provided in this area measures a temperature equal to or lower than a fixed threshold temperature (a predetermined temperature), the heater 102 heats ink. That is, a temperature adjustment control unit (not illustrated) provided in the apparatus body or the like drives the heater 102 in the area based on the value measured by the temperature sensor 103 to heat the ink (substrate). When a temperature higher than the threshold which is a predetermined temperature is detected, heating by the heater 102 is stopped. Generally, since ink of relatively low temperature flows in the vicinity of the opening 21*a* through which the ink flows into the recording element substrate 10, a corresponding temperature sensor 103 detects a relatively low temperature. As a result, by temperature control, heating by the corresponding heater 102 increases the frequency of heating or increases the heating time.

Figure 21:
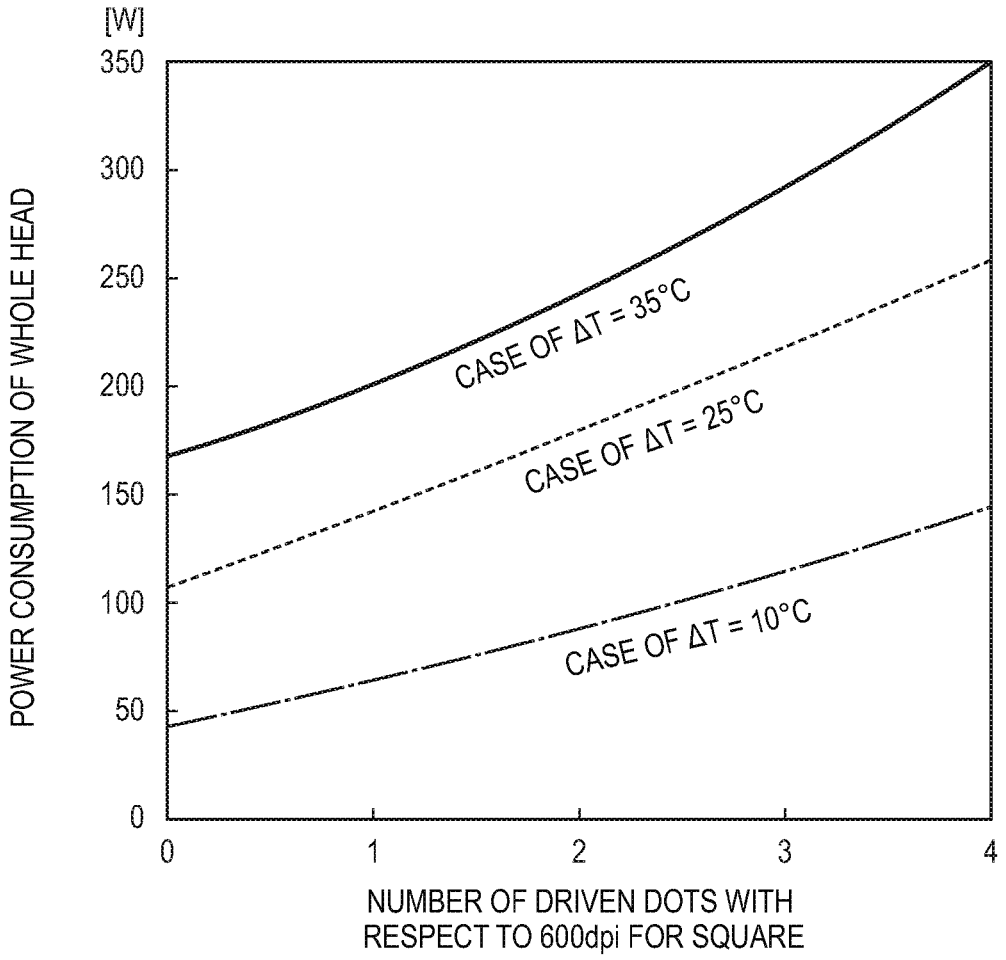
FIG. 21 is a diagram illustrating a relationship between ejection and power consumption of the liquid ejection head of the first embodiment.

On the other hand, since the temperature of the ink near the opening 21*b* through which the ink flows out is relatively high, the corresponding temperature sensor 103 detects a relatively high temperature. As a result, by temperature control, heating by the corresponding heater 102 is performed with a small frequency of heating or a short heating time, or the heating is not performed. As a result, the temperature fluctuation of the ink along the ejection port line which may be caused by the circulation of the ink can be suppressed. In the present embodiment, the number of openings and the number of temperature adjusted areas can be made equal, and the number of temperature sensors and the number of temperature adjusting heaters can be reduced. FIG. 21 illustrates power consumption of the whole head at the time of preliminary ejection for each difference ΔT between the temperature of ink supplied to the head and the adjusted temperature which is the target temperature of the head.

The ink temperature is equal to the temperature in the printer unless a special ink temperature adjusting mechanism is used. The horizontal axis indicates the number of dots per square area with one side of 600 dpi (=about 42 μm), and the vertical axis indicates the power consumption of the whole head of the present embodiment at that time. Since the flow rate of ink passing through the head increases as the number of driven dots increases, power consumption for maintaining the adjusted temperature increases. The larger the temperature difference ΔT between the adjusted temperature and the ink temperature, the larger the power consumption becomes. For example, when the adjusted temperature as the target temperature is 40° C., ΔT=35° C. in a case where the ink temperature is 5° C., and ΔT=10° C. in a case where the ink temperature is 30° C. When the number of driven dots is zero, the power consumption represents the power consumption required to maintain the adjusted temperature by compensating for heat lost due to ink circulation and heat radiation to the surroundings. The number of driven dots of the horizontal axis can be regarded as the driving frequency at the time of preliminary ejection, and the power consumption of the vertical axis can be regarded as the instantaneous temperature change at the time of ejection, and the instantaneous temperature change of the head tends to become larger as ΔT becomes larger and the driving frequency of the preliminary ejection becomes larger. Therefore, the number of preliminary ejections is ideally zero, but in a case where it is necessary to perform preliminary ejection, for example, in a case of ink with a small amount of moisture, or a case where ink around the ejection port tends to dry after being left unattended for a long time, by limiting the number of preliminary ejections per ejection port to 200 or less, the influence on printing can be prevented. In the present embodiment, during a printing operation, by controlling the number of preliminary ejections to 0 or more to 20 or less while controlling the temperature while circulating the ink, the influence of temperature change on printing is suppressed.

The number of preliminary ejections here indicates the number of preliminary ejections during an operation period for printing (recording). That is, when the liquid ejection head is in a non-recording operation period (standby state), the ejection port of the liquid ejection head is covered with a cap. In this state, when a recording signal is sent from the liquid ejection apparatus to the liquid ejection head and the cap is removed from the liquid ejection head, the liquid ejection head is shifted to the recording operation. Thereafter, after a predetermined recording operation is performed on the recording medium according to the recording signal, the liquid ejection head is covered with a cap, so the liquid ejection head is in a standby state again. The definition that the number of preliminary ejections during the recording operation period described above is 20 or less per ejection port indicates the number of preliminary ejections in the period from when the cap is removed from the liquid ejection head in the standby state until the liquid ejection head is capped again. That is, the number of preliminary ejections for performing preliminary ejection in the cap is not counted. The preliminary ejection during the recording operation period is performed on a recording medium including a recording area and a non-recording area in the case of continuous paper such as roll paper. In the case of cut paper, the preliminary ejection is performed on the recording medium, similarly to continuous paper, and/or a preliminary ejection receiver provided in a recording apparatus provided in an area (inter-page) between recording media. The number of preliminary ejections is set to 20 or less per one ejection port because it is the average value of number of all ejection ports provided in the liquid ejection head 3.

By this constitution, the number of preliminary ejections during the printing operation can be suppressed to 20 or less by circulating the ink inside and outside the pressure chamber in the liquid ejection head performing temperature adjustment. Thus, the temperature change of the liquid ejection head caused by the preliminary ejection can be suppressed, and the power consumption for raising the lowered temperature can be suppressed. Thus, the liquid ejection head and the printer having high image quality and low power consumption can be provided. In particular, in the case of a page-wide type liquid ejection head as in the present embodiment, since a plurality of recording element substrates are disposed and a considerable number of ejection ports are formed in the whole liquid ejection head, the effect of preliminary discharge is particularly great. Therefore, in a page-wide type including a plurality of recording element substrates, the number of preliminary ejections during the recording operation period described above is preferably set to 9 or less (zero or more to 9 or less) per nozzle.

In the present embodiment, an example in which a temperature sensor and a temperature adjusting heater are provided in each ejection port line is illustrated in FIGS.

Figure 22:
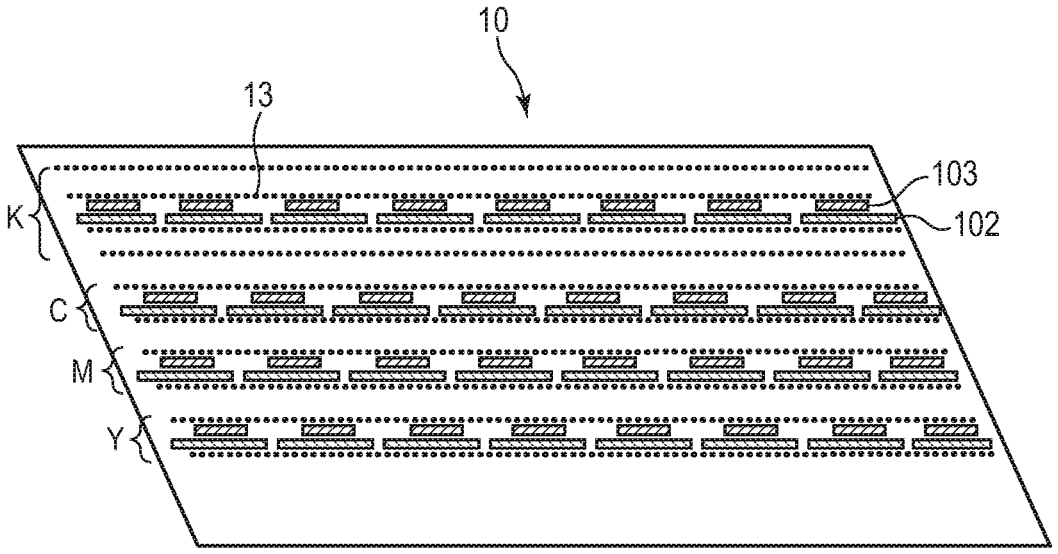
FIG. 22 is a diagram illustrating the arrangement of a temperature sensor and a temperature adjusting heater of the recording element substrate, as a modification example of the first embodiment.

20A and 20B, but the number of ejection port lines and the arrangement of the temperature sensors and the temperature adjusting heaters corresponding thereto are not limited. An example of a recording element substrate is shown in FIG. 22 in which four lines of K and two lines of each of CMY are provided as ejection port lines, and a temperature sensor and a temperature adjusted area are provided in a line for each color. In a case where a plurality of ejection port lines are provided for the same color, when one line of temperature sensors and one line of temperature adjusting heaters are used for control of the plurality of ejection port lines as illustrated, it is possible to suppress an increase in the area of the recording element substrate more than the case where temperature sensors and temperature adjusting heaters are provided for each ejection port line.

Second Embodiment

The configurations of an ink jet recording apparatus 1000 which is a liquid ejection apparatus according to a second embodiment of the present disclosure and a liquid ejection head 3 will be described. In the following description, only a part different from the first embodiment is mainly described, and a description is omitted for parts similar to the first embodiment.

Description of Ink Jet Liquid Ejection Apparatus

Figure 18A:
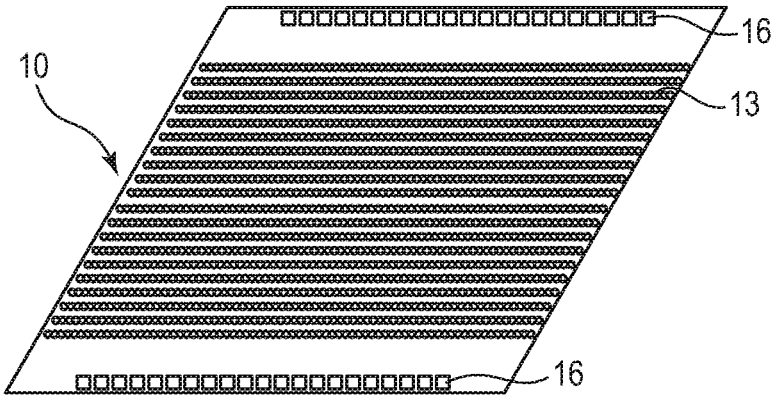
FIGS. 18A, 18B and 18C are plan views of the recording element substrate and a cover plate of the liquid ejection head illustrated in FIGS. 12A and 12B.
Figure 19:
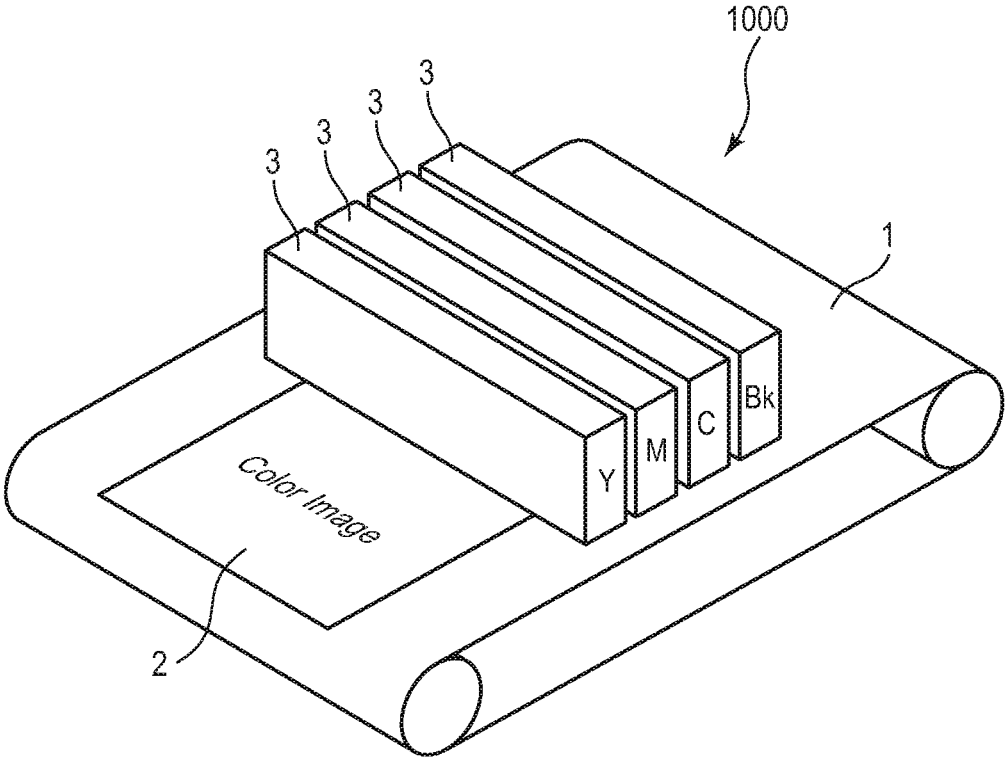
FIG. 19 is a perspective view illustrating a schematic configuration of a liquid ejection apparatus of a second embodiment.

An ink jet liquid ejection apparatus according to a second embodiment of the present disclosure is illustrated in FIG. 19. The liquid ejection apparatus 1000 of the second embodiment is different from the first embodiment in that four monochromatic liquid ejection heads 3 corresponding to inks of CMYK are disposed in parallel to perform full color recording on a recording medium. While the number of ejection port lines that can be used for one color in the first embodiment is one, the number of ejection port lines that can be used for one color in the present embodiment is 20 (FIG. 18A). Thus, recording is performed by appropriately assigning the recording data to a plurality of ejection port lines, so the recording can be performed very fast. Further, even if there is an ejection port which is in a state of non-ejection, interpolating ejection is performed from the ejection ports in another line which is disposed at the position corresponding to the conveying direction of the recording medium with respect to the ejection port, so reliability is improved, which is suitable for commercial printing. Similar to the first embodiment, a supply system of the liquid ejection apparatus 1000, the buffer tank 1003, and the main tank 1006 (FIG. 2) are fluidly connected to each liquid ejection head 3. An electric control unit that transmits electrical power and an ejection control signal to the liquid ejection head 3 is electrically connected to each liquid ejection head 3.

Description of Liquid Ejection Head Structure

Figure 12A:
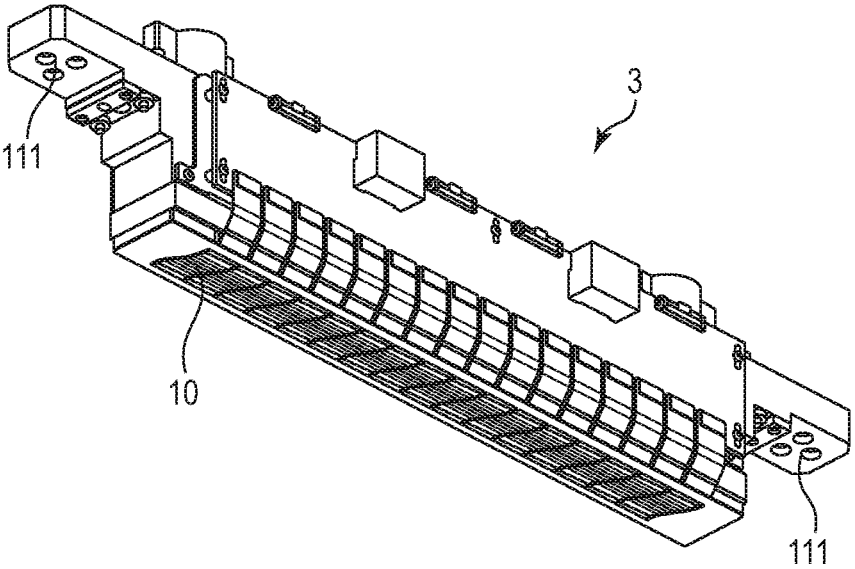
FIGS. 12A and 12B are perspective views illustrating a schematic configuration of a liquid ejection head of a second embodiment.
Figure 12B:
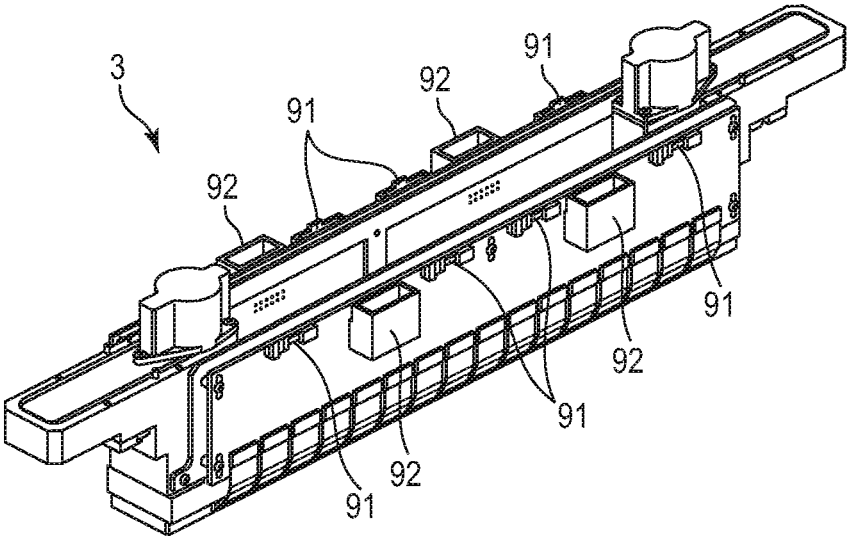

The structure of the liquid ejection head 3 according to the second embodiment of the present disclosure will be described. FIGS. 12A and 12B are perspective views of the liquid ejection head 3 according to the present embodiment. The liquid ejection head 3 is an ink jet type page-wide type recording head including 16 recording element substrates 10 arranged linearly in the longitudinal direction of the liquid ejection head 3 and capable of recording with one color of liquid. As in the first embodiment, the liquid ejection head 3 includes the liquid connecting part 111, the signal input terminals 91, and the electrical power supply terminals 92. However, in the liquid ejection head 3 of the present embodiment, since there are more ejection port lines than in the first embodiment, the signal output terminals 91 and the electrical power supply terminals 92 are disposed on both sides of the liquid ejection head 3. This is to reduce voltage drop and signal transmission delay generated in a wiring part provided on the recording element substrate 10.

Figure 13:
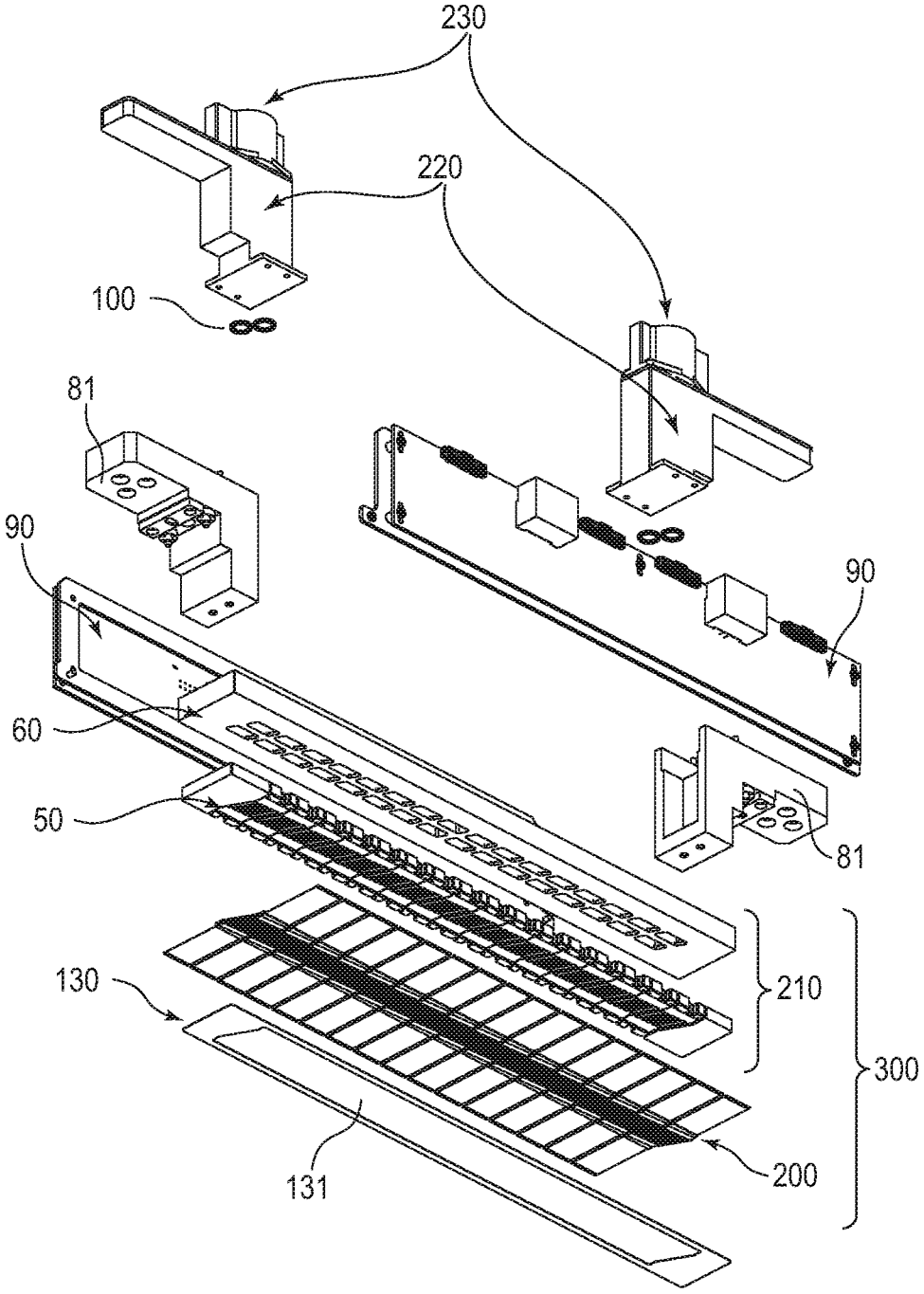
FIG. 13 is an exploded perspective view of the liquid ejection head illustrated in FIGS. 12A and 12B.

FIG. 13 is a perspective exploded view of the liquid ejection head 3, in which each component or unit constituting the liquid ejection head 3 is separately displayed for each function. The roles of the respective units and members and the order of the liquid circulation in the liquid ejection head are basically the same as the first embodiment, but the function of securing the rigidity of the liquid ejection head is different from the first embodiment. Although the rigidity of the liquid ejection head is secured mainly by the liquid ejection unit support part 81 in the first embodiment, the rigidity of the liquid ejection head is secured by the second flow passage member 60 included in the liquid ejection unit 300 in the second embodiment. The liquid ejection unit support part 81 in the present embodiment is connected to both ends of the second flow passage member 60, and the liquid ejection unit 300 is mechanically coupled with a carriage of the liquid ejection apparatus 1000 to position the liquid ejection head 3.

The liquid supply unit 220 including the negative-pressure control unit 230 and the electrical wiring substrate 90 are coupled with the liquid ejection unit support part 81. Filters (not illustrated) are respectively incorporated in the two liquid supply units 220. The two negative-pressure control units 230 are respectively set to control the pressure with relatively high and low different negative pressures. In a case where the negative-pressure control units 230 on the high pressure side and the low pressure side are installed at both ends of the liquid ejection head 3 as illustrated, the flows of the liquid in the common supply flow passage 211 and the common recovery flow passage 212 extending in the longitudinal direction of the liquid ejection head 3 face each other. Thus, heat exchange is promoted between the common supply flow passage 211 and the common recovery flow passage 212, and the temperature difference in the two common flow passages is reduced. Thus, there is an advantage that the temperature difference between the plurality of recording element substrates 10 provided along the common flow passages does not easily occur, and the recording unevenness due to the temperature difference does not easily occur.

Next, the details of the flow passage member 210 of the liquid ejection unit 300 will be described. As illustrated in FIG. 13, the flow passage member 210 is formed by laminating the first flow passage member 50 and the second flow passage member 60, and distributes liquid supplied from the liquid supply unit 220 to each ejection module 200. The flow passage member 210 functions as a flow passage member for returning the liquid recirculated from the ejection module 200 to the liquid supply unit 220. The second flow passage member 60 of the flow passage member 210 is a flow passage member in which the common supply flow passage 211 and the common recovery flow passage 212 are formed, and has a function of mainly bearing rigidity of the liquid ejection head 3. Therefore, the material of the second flow passage member 60 is preferably one having sufficient corrosion resistance to the liquid and high mechanical strength. Specifically, SUS, Ti, or alumina can be preferably used.

Figure 14A:
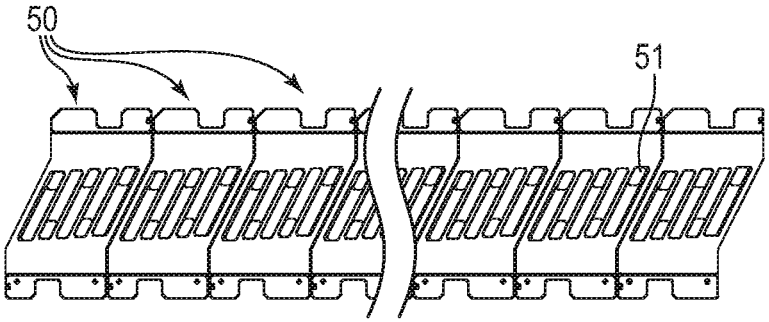
FIGS. 14A, 14B, 14C, 14D and 14E are plan views of each flow passage member of the liquid ejection head illustrated in FIGS. 12A and 12B.
Figure 14B:
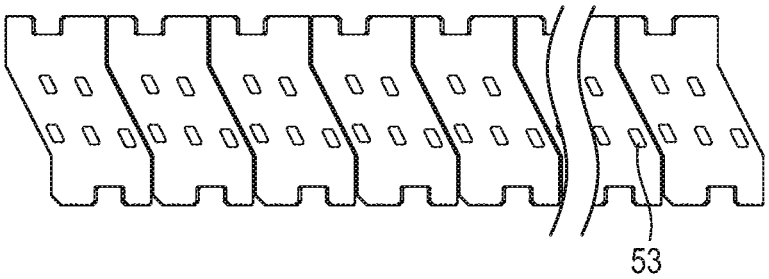
Figure 14C:
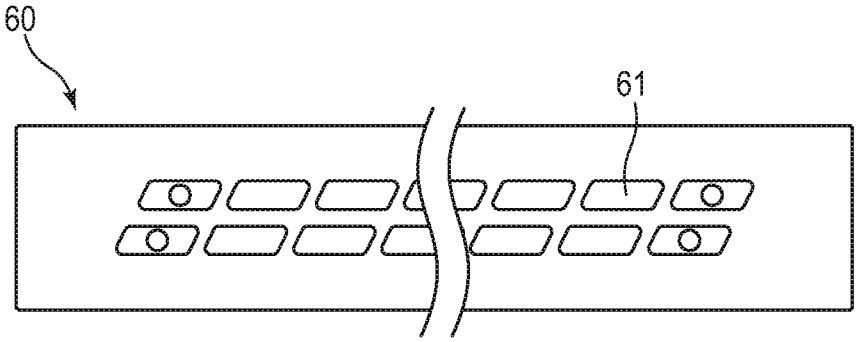
Figure 14D:
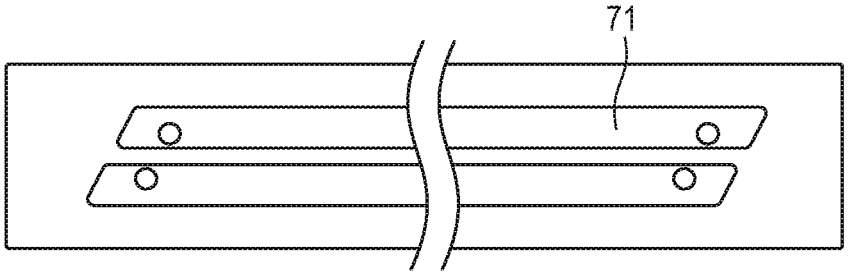
Figure 14E:
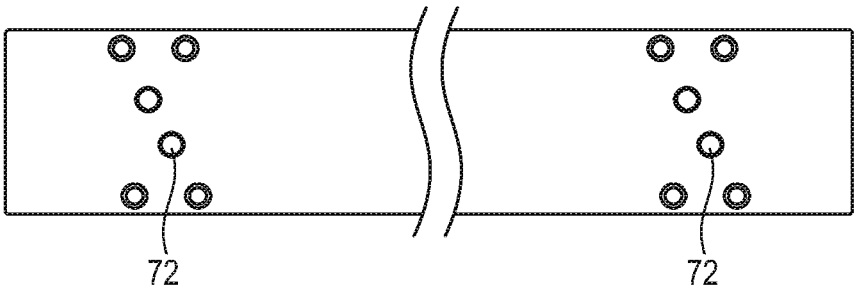

FIG. 14A is a diagram illustrating the surface of the first flow passage member 50 on the side where the ejection module 200 is mounted, and FIG. 14B is a diagram illustrating the back surface of the first flow passage member 50 on the side where it abuts on the second flow passage member 60. Different from the first embodiment, in the second embodiment, the first flow passage members 50 are obtained by adjacently arranging a plurality of members that correspond to the ejection modules 200, respectively. By taking the structure divided in this way, the plurality of modules can be arranged so as to correspond to the length of the liquid ejection head. Thus, for example, the disclosure can be particularly preferably applied to a liquid ejection head of comparatively long scales corresponding to B2 size and a length equal to or larger than the B2 size. As illustrated in FIG. 14A, the communication port 51 of the first flow passage member 50 fluidly communicates with the ejection module 200, and as illustrated in FIG. 14B, an individual communication port 53 of the first flow passage member 50 fluidly communicates with the communication port 61 of the second flow passage member 60. FIG. 14C illustrates the surface of the second flow passage member 60 abutting on the first flow passage member 50, FIG. 14D illustrates the cross section of the central part in the thickness direction of the second flow passage member 60, and FIG. 14E illustrates the surface of the second flow passage member 60 abutting on the liquid supply unit 220. Functions of a flow passage and a communication port of the second flow passage member 60 are similar to those of one color in the first embodiment. One of the common flow passage grooves 71 of the second flow passage member 60 is the common supply flow passage 211 shown in FIG. 15, and the other is the common recovery flow passage 212, and each supplies liquid from one end side to the other end side along the longitudinal direction of the liquid ejection head 3. In the present embodiment, unlike the first embodiment, the longitudinal directions of the liquid in the common supply flow passage 211 and the common recovery flow passage 212 are opposite to each other.

Figure 15:
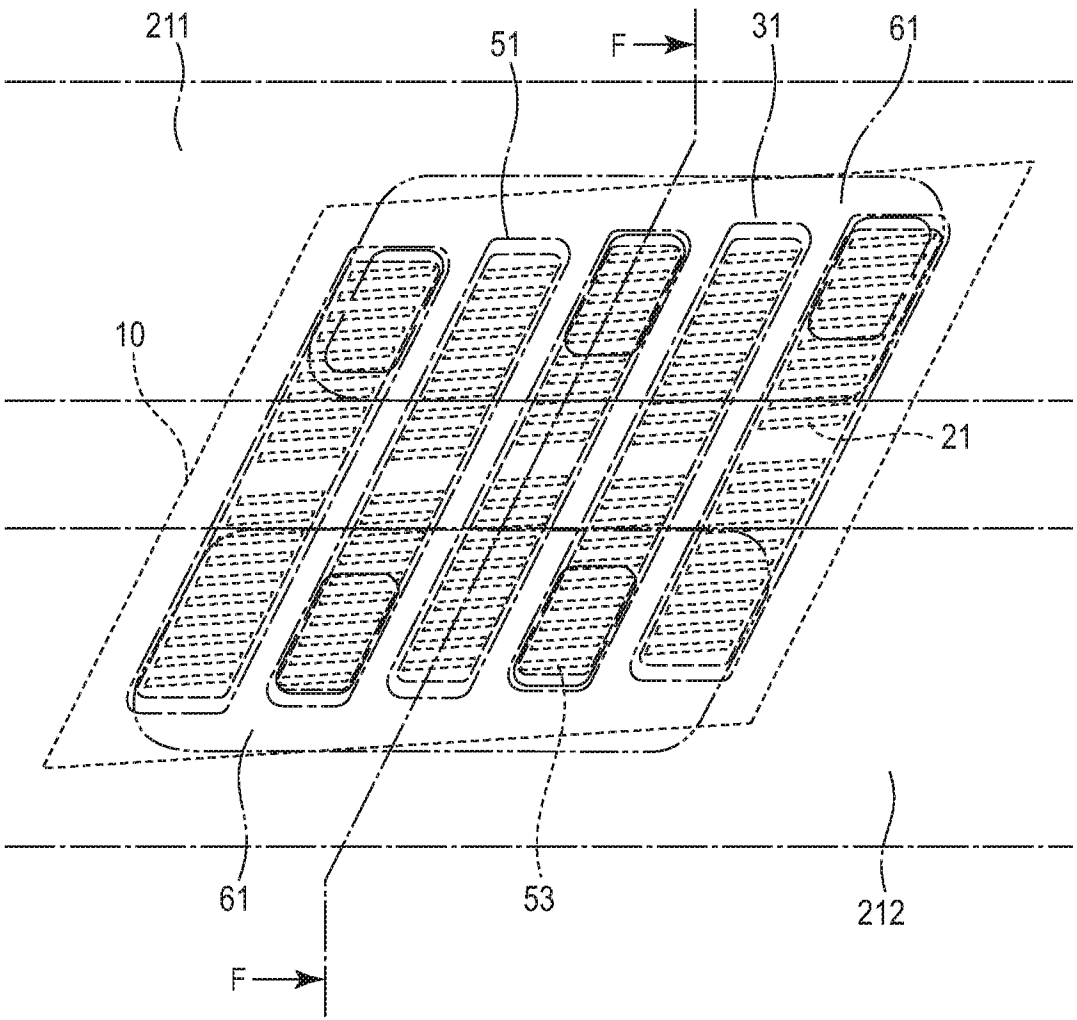
FIG. 15 is a perspective view illustrating a liquid connection relationship between a recording element substrate and a flow passage member of the liquid ejection head illustrated in FIGS. 12A and 12B.

FIG. 15 is a perspective view illustrating a liquid connection relationship between the recording element substrate 10 and the flow passage member 210. As illustrated in FIG. 15, a pair of the common supply flow passage 211 and the common recovery flow passage 212 extending in the longitudinal direction of the liquid ejection head 3 is provided in the flow passage member 210. The communication port 61 of the second flow passage member 60 is connected in alignment with the individual communication port 53 of each first flow passage member 50, and a liquid supply path communicating with the communication port 51 of the first flow passage member 50 through the common supply flow passage 211 from the communication port 72 of the second flow passage member 60 is formed. Similarly, a liquid supply path communicating with the communication port 51 of the first flow passage member 50 through the common recovery flow passage 212 from the communication port 72 of the second flow passage member 60 is also formed.

Figure 16:
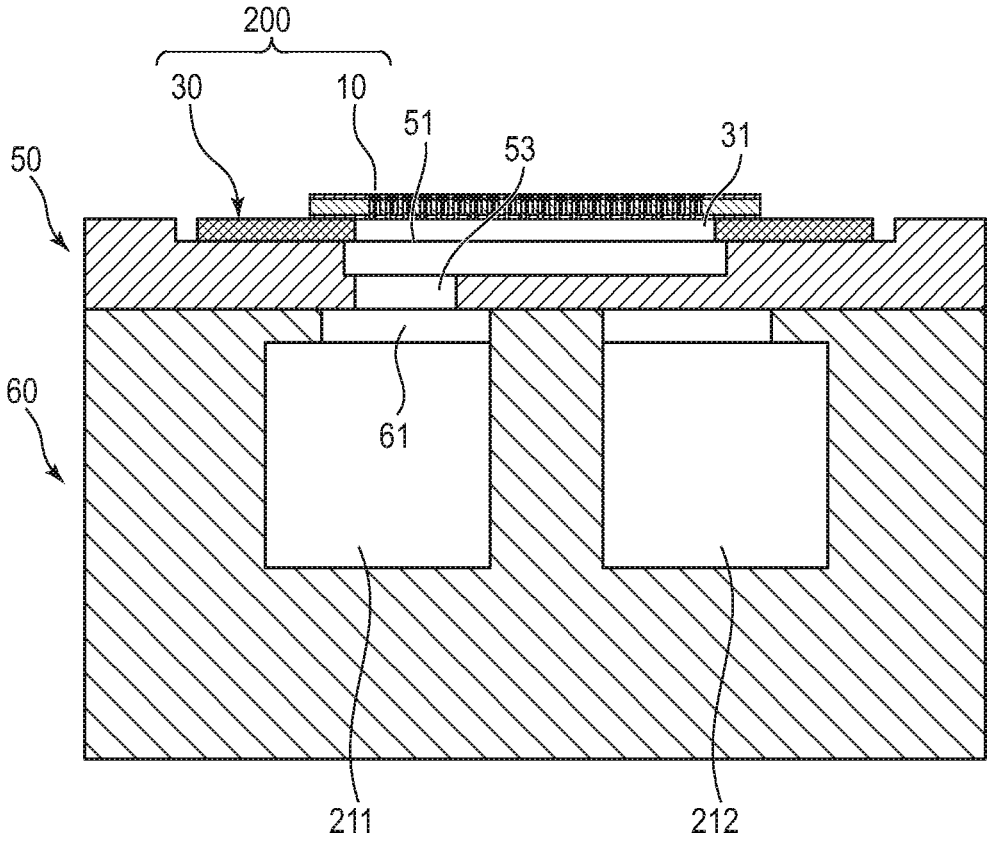
FIG. 16 is a sectional view of the liquid ejection head illustrated in FIGS. 12A and 12B.

FIG. 16 is a diagram illustrating a cross section taken along line F-F of FIG. 15. As illustrated in FIG. 16, the common supply flow passage is connected to the ejection module 200 through the communication port 61, the individual communication port 53, and the communication port 51. It is clear that the individual recovery flow passage is connected to the ejection module 200 through the same path with reference to FIG. 15. Similar to the first embodiment, a flow passage communicating with each ejection port 13 is formed in each ejection module 200 and recording element substrate 10, and a part or the whole of the supplied liquid can be recirculated through the ejection port 13 (pressure chamber 23) where the discharge operation is suspended. Similar to the first example, the common supply flow passage 211 is connected to the negative-pressure control unit 230 (high pressure side) and the common recovery flow passage 212 is connected to the negative-pressure control unit 230 (low pressure side) through the liquid supply unit 220. Therefore, by this differential pressure, a flow flowing from the common supply flow passage 211 to the common recovery flow passage 212 through the ejection port 13 (pressure chamber 23) of the recording element substrate 10 is generated.

Description of Ejection Module

Figure 17A:
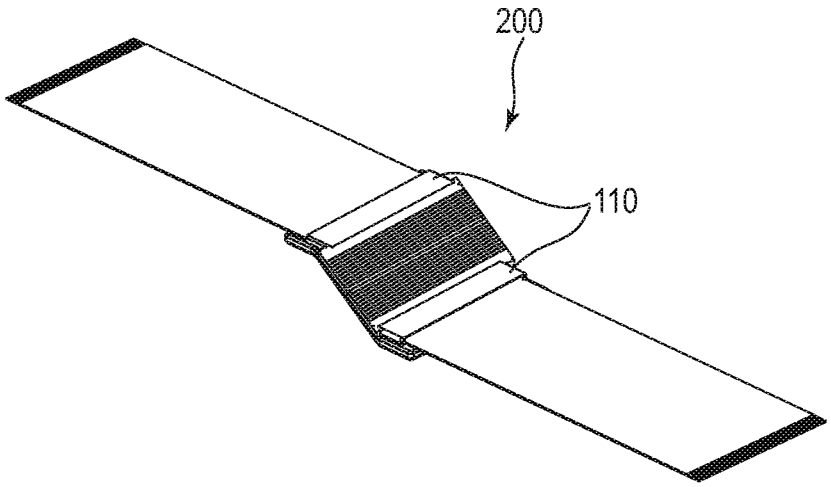
FIGS. 17A and 17B are a perspective view and an exploded perspective view of a ejection module of the liquid ejection head illustrated in FIGS. 12A and 12B.
Figure 17B:
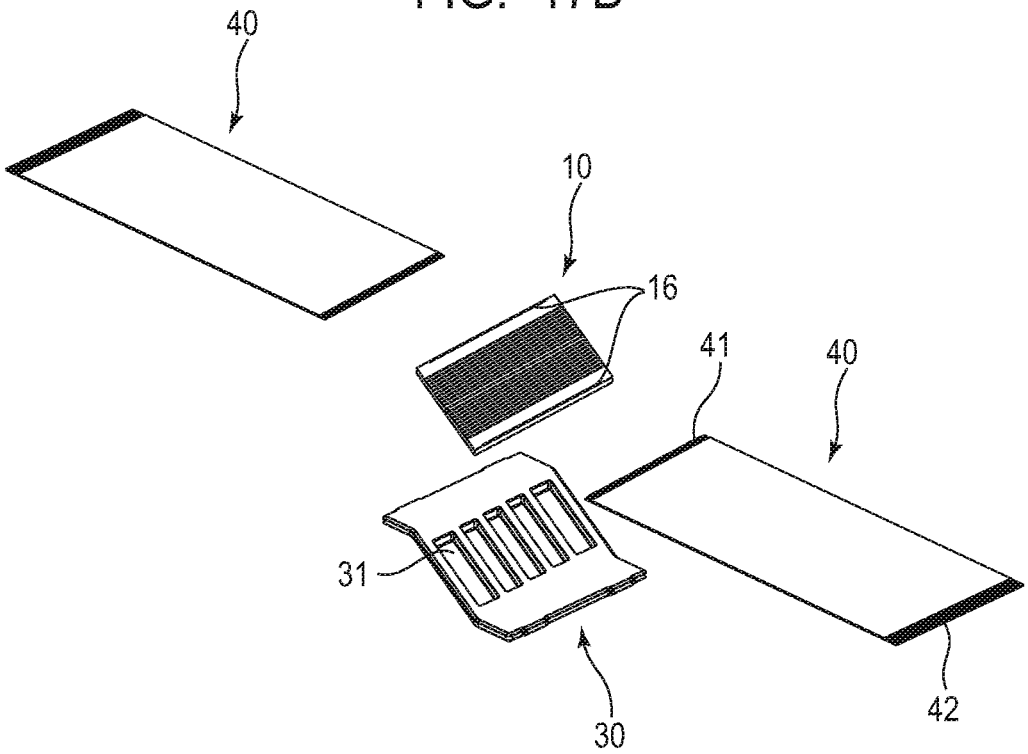

FIG. 17A illustrates a perspective view of one ejection module 200, and FIG. 17B illustrates an exploded view thereof. It is different from the first embodiment in the following points. A plurality of terminals 16 are disposed on both sides along the direction of a plurality of ejection port lines of the recording element substrate 10 (long sides of each recording element substrate 10). Two flexible wiring substrates 40 electrically connected to the terminals 16 are also disposed on one recording element substrate 10. This is because the number of ejection port lines provided on the recording element substrate 10 is 20, which is significantly increased more than eight lines in the first embodiment. That is, an object is to suppress the maximum distance from the terminal 16 to the recording element 15 provided corresponding to the ejection port line short, to thereby reduce voltage drop and signal transmission delay caused in the wiring part in the recording element substrate 10. The liquid communication port 31 of the supporting member 30 is opened so as to straddle all the ejection port lines provided on the recording element substrate 10. Other aspects are similar to those in the first embodiment.

Description of Structure of a Recording Element Substrate

Figure 18B:
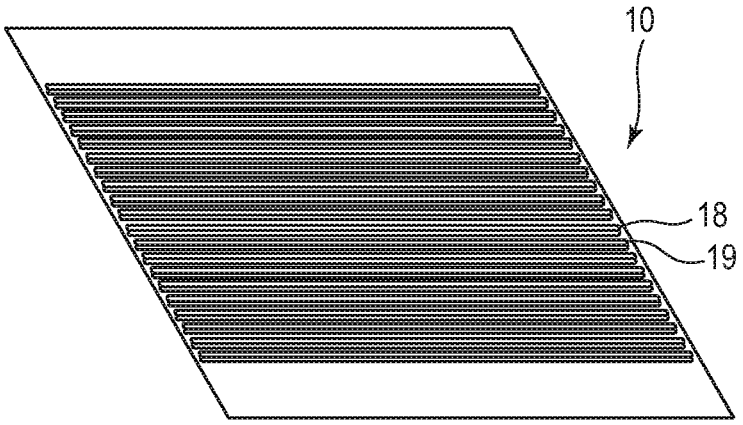
Figure 18C:
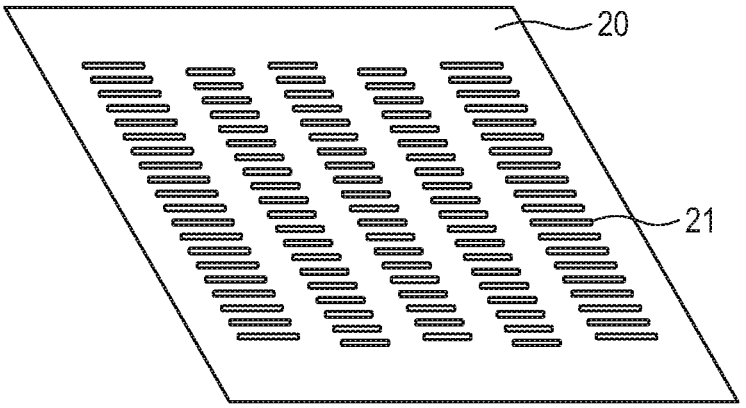

FIG. 18A is a schematic diagram of the surface of the recording element substrate 10 on which the ejection port 13 is disposed, and FIG. 18C is a schematic diagram illustrating the back surface of the surface of FIG. 18A. FIG. 18B is a schematic diagram illustrating the surface of the recording element substrate 10 when a lid member 20, illustrated in FIG. 18C, provided on the back surface side of the recording element substrate 10 is removed. As illustrated in FIG. 18B, the liquid supply path 18 and the liquid recovery path 19 are alternately provided along the ejection port line direction on the back surface of the recording element substrate 10. Although the number of ejection port lines is greatly increased from that of the first embodiment, the essential difference from the first embodiment is that the terminals 16 are disposed on both sides along the ejection port line direction of the recording element substrate as described above. A basic configuration is similar to the first embodiment, such as providing a set of the liquid supply path 18 and the liquid recovery path 19 for each ejection port line, and providing on the lid member 20 the opening 21 communicating with the liquid communication port 31 of the supporting member 30.

Other Configurations

In each embodiment described above, an example in which a pump as a power source for circulation is provided in the liquid ejection apparatus body which is outside of the liquid ejection head is illustrated, but the power source may be provided on the liquid ejection head 3. In particular, a micropump (micro actuator) including a heat generating element, a piezoelectric element or the like may be provided on the recording element substrate 10 (FIGS. 8A and 8B) including the recording element, and a pump on the apparatus body side and a micropump may be used in combination.

In a case where the micropump is provided on the recording element substrate, a common liquid chamber (not illustrated) for holding liquid, a first flow passage (not illustrated) communicating the pressure chamber 23 with the common liquid chamber, and a second flow passage (not illustrated) communicating the pressure chamber 23 with the common liquid chamber are provided. A configuration in which the micropump is provided in the second flow passage can be applied. The second flow passage may be a substantially U-shaped flow passage having a bent part.

As described in the above embodiments, in the liquid ejection head performing temperature adjustment, the average number of preliminary ejections during a recording operation period per ejection port of the liquid ejection head can be suppressed to 20 or less, by ink circulating inside and outside the pressure chamber 23. Thus, temperature change and increase in power consumption caused by preliminary ejections are prevented, and the liquid ejection head and the liquid ejection apparatus having high image quality and low power consumption can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-190400, filed Oct. 5, 2018, which is hereby incorporated by reference herein in its entirety.

What is claimed is:

1. A liquid ejection apparatus comprising:

a liquid ejection head, an electric control unit that transmits electrical power and an ejection control signal to the liquid ejection head;

the liquid ejection head comprising:

a nozzle including an ejection port for ejecting a liquid, and a pressure chamber in which an energy generating element that generates energy used for discharging the liquid from the ejection port is disposed; and a heating unit that heats the liquid, wherein during an operation period in which a recording on a recording medium is performed, the liquid in the pressure chamber is circulated to and from an outside of the pressure chamber, and wherein an average number of preliminary ejections per nozzle of all the nozzles during the operation period is controlled to be equal to or greater than 0 and equal to or less than 20 by means of the electric control unit, wherein the operation period is from when the liquid ejection head is in a standby state until when the liquid ejection head again enters the standby state after the recording is performed, in the standby state, the ejection port is covered with a cap, wherein the nozzle includes the ejection port part to communicate the ejection port with the pressure chamber, when the upstream-side height of the supply-side flow passage at communication part between the ejection port part and the pressure chamber is indicated as H [μm], the length of the ejection port part in the direction of ejecting a liquid from the ejection port is indicated as P [μm], and the length of the ejection port part in the flow direction of the liquid in the pressure chamber is indicated as W [μm], the height H, the length P and the length W have a relationship satisfying the following Expression (1)

$$H^{-0.34} \times P^{-0.66} \times W > 1.5 \quad (1).$$

2. The liquid ejection apparatus according to claim 1, the liquid ejection head further comprising a temperature sensor that measures a temperature of the liquid, wherein the liquid is heated to a predetermined temperature by the heating unit according to a value measured by the temperature sensor.

3. The liquid ejection apparatus according to claim 2, wherein the predetermined temperature is higher than a temperature of the liquid supplied to the liquid ejection head.

4. The liquid ejection apparatus according to claim 1, wherein the heating unit is provided separately from the energy generating element.

5. The liquid ejection apparatus according to claim 1, wherein the heating unit is the energy generating element.

6. The liquid ejection apparatus according to claim 1, wherein the preliminary ejection is performed by a signal different from a signal for the recording.

7. The liquid ejection apparatus according to claim 1, wherein the preliminary ejection is performed toward a preliminary ejection receiver.

8. The liquid ejection apparatus according to claim 1, wherein the preliminary ejection is performed toward the recording medium.

9. The liquid ejection apparatus according to claim 1, wherein a supply-side flow passage connected to the pressure chamber to supply the liquid to the pressure chamber, and a recovery-side flow passage connected to the pressure chamber to recover the liquid from the pressure chamber are provided.

10. The liquid ejection apparatus according to claim 9, wherein a recording element substrate having the energy generating element and the heating unit is provided, and wherein a supply port for supplying the liquid to the supply-side flow passage, the supply port penetrating the recording element substrate, and a recovery port for recovering the liquid from the recovery-side flow passage, the recovery port penetrating the recording element substrate are provided.

11. The liquid ejection apparatus according to claim 10, wherein a supply port line in which a plurality of the supply ports are arranged; a recovery port line in which a plurality of the recovery ports are arranged; a liquid supply path for supplying the liquid to the supply port line; and a liquid recovery path for recovering the liquid from the recovery port line are provided, and wherein the supply port line, the liquid supply path, the recovery port line, and the liquid recovery path are disposed alongside each other.

12. The liquid ejection apparatus according to claim 9, wherein the average number of preliminary ejections per nozzle during the operation period is equal to or greater than 0 and equal to or less than 9.

13. The liquid ejection apparatus according to claim 9, wherein a pump as a power source for circulating the liquid is provided on a recording element substrate having the energy generating element and the heating unit.

14. The liquid ejection apparatus according to claim 13, wherein a common liquid chamber for holding the liquid, a first flow passage communicating the pressure chamber with the common liquid chamber, and a second flow passage communicating the pressure chamber with the common liquid chamber are provided, and the pump is provided in the second flow passage.

15. The liquid ejection head apparatus according to claim 14, wherein the second flow passage has a substantially U shape having a bent part.

16. The liquid ejection apparatus according to claim 13, wherein the pump is a heat generating element provided separately from the energy generating element and generates air bubbles in the liquid.

17. The liquid ejection apparatus according to claim 9, wherein a pump as a power source for circulating the liquid is provided outside the liquid ejection head.

18. The liquid ejection apparatus according to claim 9, wherein the energy generating element is a heat generating element for generating air bubbles in the liquid.

* * * * *